US011821097B2

(12) United States Patent
Luo et al.

(10) Patent No.: US 11,821,097 B2
(45) Date of Patent: Nov. 21, 2023

(54) INTERFACIAL ELECTROFABRICATION OF FREESTANDING BIOPOLYMER MEMBRANES WITH DISTAL ELECTRODES

(71) Applicant: The Catholic University of America, Washington, DC (US)

(72) Inventors: Xiaolong Luo, Washington, DC (US); Piao Hu, Washington, DC (US)

(73) Assignee: The Catholic University of America, Washington, DC (US)

( * ) Notice: Subject to any disclaimer, the term of this patent is extended or adjusted under 35 U.S.C. 154(b) by 0 days.

(21) Appl. No.: 17/470,105

(22) Filed: Sep. 9, 2021

(65) Prior Publication Data

US 2022/0074069 A1 Mar. 10, 2022

Related U.S. Application Data

(60) Provisional application No. 63/076,621, filed on Sep. 10, 2020.

(51) Int. Cl.

| | |
|---|---|
| ***C25D 17/00*** | (2006.01) |
| ***C25D 17/10*** | (2006.01) |
| ***C25D 1/00*** | (2006.01) |

(52) U.S. Cl.

CPC ..... *C25D 17/002* (2013.01); *C25D 1/00* (2013.01); *C25D 17/10* (2013.01)

(58) Field of Classification Search

None

See application file for complete search history.

(56) References Cited

PUBLICATIONS

English translation of WO 2012060275. (Year: 2012).*

Hu et al. "Interfacial Electrofabrication of Freestanding Biopolymer Membranes with Distal Electrodes", Langmuir, 2020, 36, 11034-11043. (Year: 2020).*

Tamura et al., "Differences between Phthaleins and Sulfonphthaleins", Journal of the Pharmaceutical Society of Japan, 1997, 117, 10-11, 764-770. (Year: 1997).*

Chen, X.; Shen, J., Review of membranes in microfluidics. Journal of Chemical Technology & Biotechnology 2017, 92 (2), 271-282.

(Continued)

*Primary Examiner* — Stefanie S Wittenberg

(74) *Attorney, Agent, or Firm* — Ajay A. Jagtiani; Miles & Stockbridge PC

(57) ABSTRACT

The present disclosure relates to a device for and a method of interfacial electrofabrication of freestanding biopolymer membranes comprising at least one anode; at least one cathode; at least one anode electrolyte; and at least one cathode electrolyte, wherein at least a portion of the at least one anode electrolyte and the at least one cathode electrolyte form an interface, wherein at least one polyelectrolyte complex membrane (PECM) forms at the interface of the at least one anode electrolyte and the at least one cathode electrolyte, wherein the at least one anode electrolyte and the at least one cathode electrolyte are separated by the PECM, wherein the at least one anode is disposed in the at least one anode electrolyte, wherein the at least one cathode is disposed in the at least one cathode electrolyte, and wherein the at least one anode and the at least one cathode are distal from the interface of the at least one anode electrolyte and the at least one cathode electrolyte.

25 Claims, 15 Drawing Sheets
(15 of 15 Drawing Sheet(s) Filed in Color)

(56) References Cited

PUBLICATIONS

Koev, S. T.; Powers, M. A.; Yi, H.; Wu, L.-Q.; Bentley, W. B.; Rubloff, G. W.; Payne, G. F.; Ghodssi, R., Mechano-transduction of DNA hybridization and dopamine oxidation through electrodeposited chitosan network. Lab on a Chip 2007, 7 (1), 103-111.
Tan, X.; Rodrigue, D., A Review on Porous Polymeric Membrane Preparation. Part I: Production Techniques with Polysulfone and Poly (Vinylidene Fluoride). Polymers 2019, 11 (7), 1160.
Tasselli, F.; Jansen, J.; Drioli, E., PEEKWC ultrafiltration hollow-fiber membranes: Preparation, morphology, and transport properties. Journal of Applied Polymer Science 2004, 91 (2), 841-853.
Remanan, S.; Sharma, M.; Bose, S.; Das, N. C., Recent advances in preparation of porous polymeric membranes by unique techniques and mitigation of fouling through surface modification. ChemistrySelect 2018, 3 (2), 609-633.
Guillen, G. R.; Pan, Y.; Li, M.; Hoek, E. M., Preparation and characterization of membranes formed by nonsolvent induced phase separation: a review. Industrial & Engineering Chemistry Research 2011, 50 (7), 3798-3817.
Kazek-Kęsik, A.; Krok-Borkowicz, M.; Dercz, G.; Donesz-Sikorska, A.; Pamuła, E.; Simka, W., Multilayer coatings formed on titanium alloy surfaces by plasma electrolytic oxidation—electrophoretic deposition methods. Electrochimica Acta 2016, 204, 294-306.
Boccaccini, A.; Keim, S.; Ma, R.; Li, Y.; Zhitomirsky, I., Electrophoretic deposition of biomaterials. Journal of the Royal Society Interface 2010, 7 (suppl_5), S581-S613.
Schwarzacher, W., Electrodeposition: a technology for the future. Electrochemical Society Interface 2006, 15 (1), 32-33.
Li, J.; Wu, S.; Kim, E.; Yan, K.; Liu, H.; Liu, C.; Dong, H.; Qu, X.; Shi, X.; Shen, J., Electrobiofabrication: electrically based fabrication with biologically derived materials. Biofabrication 2019, 11 (3), 032002.
Jayakrishnan, D. S., Electrodeposition: the versatile technique for nanomaterials. In Corrosion protection and control using nanomaterials, Elsevier: 2012; pp. 86-125.
Schwartz, D. T., Electrodeposition and nanobiosystems. The Electrochemical Society Interface. 2006, 15(1), 34.
Xu. W.; Fu. K.; Bohn. P. W., Electrochromic sensor for multiplex detection of metabolites enabled by closed bipolar electrode coupling. ACS Sensors. 2017, 2 (7), 1020-6.
Walker, G.; Ramsey, J.; Cavin III, R.; Herr, D.; Merzbacher, C.; Zhirnov, V., A framework for bioelectronics: Discovery and innovation. National Institute of Standards and Technology 2009.
Agarwala, S.; Lee, J. M.; Ng, W. L.; Layani, M.; Yeong, W. Y.; Magdassi, S., A novel 3D bioprinted flexible and biocompatible hydrogel bioelectronic platform. Biosensors and Bioelectronics 2018, 102, 365-371.
Hsiao, Y.-S.; Ho, B.-C.; Yan, H.-X.; Kuo, C.-W.; Chueh, D.-Y.; Yu, H.-h.; Chen, P., Integrated 3D conducting polymer-based bioelectronics for capture and release of circulating tumor cells. Journal of Materials Chemistry B 2015, 3 (25), 5103-5110.
Katz, E., Implantable bioelectronics—editorial introduction. Implantable bioelectronics. Wiley, Weinheim 2014.
Prakash, S.; Chakrabarty, T.; Singh, A. K.; Shahi, V. K., Polymer thin films embedded with metal nanoparticles for electrochemical biosensors applications. Biosensors and Bioelectronics 2013, 41, 43-53.
Simon, D.; Ware, T.; Marcotte, R.; Lund, B. R.; Smith, D. W.; Di Prima, M.; Rennaker, R. L.; Voit, W., A comparison of polymer substrates for photolithographic processing of flexible bioelectronics. Biomedical Microdevices 2013, 15 (6), 925-939.
Willner, I.; Baron, R.; Willner, B., Integrated nanoparticle- biomolecule systems for biosensing and bioelectronics. Biosensors and Bioelectronics 2007, 22 (9-10), 1841-1852.
Svennersten, K.; Larsson, K. C.; Berggren, M.; Richter-Dahlfors, A., Organic bioelectronics in nanomedicine. Biochimica et Biophysica Acta (BBA)—General Subjects 2011, 1810 (3), 276-285.
Berggren, M.; Richter-Dahlfors, A., Organic bioelectronics. Advanced Materials 2007, 19 (20), 3201-3213.
Yuk, H.; Lu, B.; Zhao, X., Hydrogel bioelectronics. Chemical Society Reviews 2019, 48 (6), 1642-1667.
Zhang, A.; Lieber, C. M., Nano-bioelectronics. Chemical Reviews 2016, 116 (1), 215-257.
Bhattarai, N.; Gunn, J.; Zhang, M., Chitosan-based hydrogels for controlled, localized drug delivery. Advanced Drug Delivery Reviews 2010, 62 (1), 83-99.
Croisier, F.; Jerôme, C., Chitosan-based biomaterials for tissue engineering. European Polymer Journal 2013, 49 (4), 780-792.
Koev, S.; Dykstra, P.; Luo, X.; Rubloff, G.; Bentley, W.; Payne, G.; Ghodssi, R., Chitosan: an integrative biomaterial for lab-on-a-chip devices. Lab on a Chip 2010, 10 (22), 3026-3042.
Suginta, W.; Khunkaewla, P.; Schulte, A., Electrochemical biosensor applications of polysaccharides chitin and chitosan. Chemical Reviews 2013, 113 (7), 5458-5479.
Rafique, A.; Zia, K. M.; Zuber, M.; Tabasum, S.; Rehman, S., Chitosan functionalized poly (vinyl alcohol) for prospects biomedical and industrial applications: A review. International Journal of Biological Macromolecules 2016, 87, 141-154.
Wu, L.-Q.; Gadre, A. P.; Yi, H.; Kastantin, M. J.; Rubloff, G. W.; Bentley, W. E.; Payne, G. F.; Ghodssi, R., Voltage-dependent assembly of the polysaccharide chitosan onto an electrode surface. Langmuir 2002, 18 (22), 8620-8625.
Wu, S.; Yan, K.; Li, J.; Huynh, R. N.; Raub, C. B.; Shen, J.; Shi, X.; Payne, G. F., Electrical cuing of chitosan's mesoscale organization. Reactive and Functional Polymers 2020, 104492.
Yi, H.; Wu, L.-Q.; Bentley, W. E.; Ghodssi, R.; Rubloff, G. W.; Culver, J. N.; Payne, G. F., Biofabrication with chitosan. Biomacromolecules 2005, 6 (6), 2881-2894.
Pang, X.; Zhitomirsky, I., Electrodeposition of composite hydroxyapatite chitosan films. Materials Chemistry and Physics 2005, 94 (2-3), 245-251.
Fusco, S.; Chatzipirpiridis, G.; Sivaraman, K. M.; Ergeneman, O.; Nelson, B. J.; Pané, S., Chitosan electrodeposition for microrobotic drug delivery. Advanced Healthcare Materials 2013, 2 (7), 1037-1044.
Cheng, Y.; Gray, K. M.; David, L.; Royaud, I.; Payne, G. F.; Rubloff, G. W., Characterization of the cathodic electrodeposition of semicrystalline chitosan hydrogel. Materials Letters 2012, 87, 97-100.
Cheng, Y.; Luo, X.; Betz, J.; Buckhout-White, S.; Bekdash, O.; Payne, G. F.; Bentley, W. E.; Rubloff, G. W., In situ quantitative visualization and characterization of chitosan electrodeposition with paired sidewall electrodes. Soft Matter 2010, 6 (14), 3177-3183.
Kim, E.; Xiong, Y.; Cheng, Y.; Wu, H.-C.; Liu, Y.; Morrow, B. H.; Ben-Yoav, H.; Ghodssi, R.; Rubloff, G. W.; Shen, J., Chitosan to connect biology to electronics: Fabricating the bio-device interface and communicating across this interface. Polymers 2015, 7 (1), 1-46.
Tsai, C.; Payne G. F.; Shen, J., Exploring pH-responsive, switchable crosslinking mechanisms for programming reconfigurable hydrogels based on aminopolysaccharides. Chemistry of Materials 2018 13;30 (23), 8597-605.
Dharmadasa, I.; Haigh, J., Strengths and advantages of electrodeposition as a semiconductor growth technique for applications in macroelectronic devices. Journal of The Electrochemical Society 2006, 153 (1), G47-G52.
Hu, P.; Raub, C. B.; Choy, J. S.; Luo, X., Modulating the properties of flow-assembled chitosan membranes in microfluidics with glutaraldehyde crosslinking. Journal of Materials Chemistry B 2020, 8 (12), 2519-2529.
Pham, P.; Vo, T.; Luo, X., Steering air bubbles with an add-on vacuum layer for biopolymer membrane biofabrication in PDMS microfluidics. Lab on a Chip 2017, 17 (2), 248-255.
Luo, X.; Wu, H.-C.; Betz, J.; Rubloff, G. W.; Bentley, W. E., Air bubble-initiated biofabrication of freestanding, semi-permeable biopolymer membranes in PDMS microfluidics. Biochemical Engineering Journal 2014, 89, 2-9.
Luo, X.; Wu, H.-C.; Tsao, C.-Y.; Cheng, Y.; Betz, J.; Payne, G. F.; Rubloff, G. W.; Bentley, W. E., Biofabrication of stratified biofilm mimics for observation and control of bacterial signaling. Biomaterials 2012, 33 (20), 5136-5143.

(56) References Cited

PUBLICATIONS

Luo, X.; Berlin, D. L.; Betz, J.; Payne, G. F.; Bentley, W. E.; Rubloff, G. W., In situ generation of pH gradients in microfluidic devices for biofabrication of freestanding, semi-permeable chitosan membranes. Lab on a Chip 2010, 10 (1), 59-65.
Gu, Y.; Hegde, V.; Bishop, K. J., Measurement and mitigation of free convection in microfluidic gradient generators. Lab on a Chip 2018, 18 (22), 3371-8.
Ly, K. L.; Raub, C. B.; Luo, X., Tuning the porosity of biofabricated chitosan membranes in microfluidics with co-assembled nanoparticles as templates. Materials Advances 2020, 1 (1), 34-44.
Tinevez, J.-Y.; Perry, N.; Schindelin, J.; Hoopes, G. M.; Reynolds, G. D.; Laplantine, E.; Bednarek, S. Y.; Shorte, S. L.; Eliceiri, K. W., TrackMate: An open and extensible platform for single-particle tracking. Methods 2017, 115, 80-90.
Tamura, Z.; Maeda, M., Differences between phthaleins and sulfonphthaleins. Yakugaku zasshi: Journal of the Pharmaceutical Society of Japan 1997, 117 (10-11), 764-770.
Li, K.; Correa, S.; Pham, P.; Raub, C.; Luo, X., Birefringence of flow-assembled chitosan membranes in microfluidics. Biofabrication 2017, 9 (3), 034101.

* cited by examiner

INTERFACIAL ELECTROFABRICATION OF FREESTANDING BIOPOLYMER MEMBRANES WITH DISTAL ELECTRODES

CROSS-REFERENCE TO RELATED APPLICATIONS

This application claims benefit of priority of U.S. Provisional Patent Application No. 63/076,621 entitled, "INTERFACIAL ELECTROFABRICATION OF FREESTANDING BIOPOLYMER MEMBRANES WITH DISTAL ELECTRODES" filed Sep. 10, 2020. The entire contents and disclosures of these patent applications are incorporated herein by reference in their entirety.

BACKGROUND

Field of the Invention

The present disclosure relates to a device for and a method of interfacial electrofabricatio of freestanding biopolymer membrane. The present disclosure also relates to the freestanding biopolymer membrane fabricated using the method provided in the present disclosure and applications of the presently disclosed freestanding biopolymer membrane.

Background of the Invention

Membranes have been broadly employed in the chemical industry and biological engineering with versatile functions, user and environmental friendliness, and compelling economic benefits as compared to traditional separation techniques.[1] A variety of membrane preparation methods such as solution casting, phase inversion, track-etching, stretching, electrospinning, or sintering have been developed to manufacture membranes for specific applications.[2-6] Among these, the use of electrical signals to guide the deposition of materials in general, and membranes in particular, stands out as a well-established and convenient method. The advantages of the electrodeposition process include time-saving preparation, versatile operation, high uniformity, low energy consumption, and straightforward manipulation over key parameters such as current, voltage and time.[7-10] Therefore, electrodeposition has been extensively applied in the surface coating of metal and biomaterials, fabrication of electronic chips, and integration of organics with devices.[9-13]

With the rapid development of bioelectronics and biomedical devices, more and more attention has been drawn to the integration of organic biological polymers onto inorganic electronic devices such as biosensors, lab-on-a-chip devices, and bio-microelectromechanical systems (bioMEMS). Diverse bioelectronics and biomedical platforms have been developed aiming at various purposes by converging the biocompatibility, biofunctionality and mechanical flexibility of biopolymers and the real-time transmission and multiplexing capabilities of electronics.[14-21] Numerous bioelectronics have taken the advantages of the special properties of carbon-based biomaterials,[21-24] including their similarity to biological tissues and versatility in electrical, mechanical and biofunctional engineering, to minimize the intrinsic differences between biological tissues and man-made electronics.

Chitosan, one of the most adopted biomaterials in biomedical and bioelectronics fields, has been broadly used for applications ranging from tissue engineering to biomedical drug delivery to bio-microdevices.[25-29] Chitosan is soluble in acidic conditions but becomes insoluble in pH higher than 6.3, making its gelation closed to physiological conditions. Owing to its versatile amine chemistry for biological integration and its pH-dependent solubility for film formation, chitosan is an ideal candidate for broad biological and biomedical applications. Over the last two decades, depositing chitosan on the cathode surface via electrical signals has been widely explored by imposing a high pH gradient around the cathode with water electrolysis to induce structure formation.[10, 30-37] The cathodic neutralization prompts direct electron transfer to the amine groups of chitosan chains and deposits a hydrogel or membrane layer on the electrode surfaces. Therefore, chitosan electrodeposition presents an integrating and communicating interface between electronic devices and biological entities with unique spatiotemporal programmability.[10, 31-32, 36-38] Several challenges, however, remain in fabricating chitosan membrane structures with electrodeposition. First, the electrodeposition on the electrode surface is not suitable to fabricate standalone membranes that allow for fluidic access to both sides of the structure for broader applications. Second, mass production of chitosan membranes with electrodeposition is difficult due to the need of at least one working electrode for each film. Finally, the fabricated films are difficult to harvest and repackage for further usage, and the films may be contaminated with metallic ions if inert electrodes of precious metals are not used.[39] Recently, standalone membrane structures have been assembled with flows in microchannels by hydroxide ions diffusing from a nearby basic buffer solution.[40-45] Nevertheless, the flow-assembled method remains not scalable due to its technical complexity.

Therefore, there is a need for an innovation of electrofabricating freestanding chitosan membranes at the interface of polyelectrolytes without electrodes at the fabrication site, which dramatically differs from the widely explored electrodeposition of chitosan films on electrode surfaces and can be readily scalable.

SUMMARY

According to a first broad aspect of the present disclosure, an interfacial electrofabrication device of freestanding biopolymer membranes comprising: at least one anode; at least one cathode; at least one anode electrolyte; and at least one cathode electrolyte, is provided, wherein the anode electrolyte and the cathode electrolyte are in contact with each other and forms a clear interface, wherein at least one polyelectrolyte complex membrane (PECM) forms at the interface of the anode electrolyte and the cathode electrolyte, wherein the anode electrolyte and the cathode electrolyte are separated by the PECM, wherein the anode is immerged in anode electrolyte, wherein the cathode is immerged in the cathode electrolyte, and wherein the anode and cathode are away from the interface of the anode electrolyte and the cathode electrolyte is provided.

According to a second broad aspect of the present disclosure, a freestanding biopolymer membrane electrofabricated using the device in the present disclosure is provided.

Other aspects and features of the present disclosure will become apparent to those skilled in the art upon review of the following description of specific embodiments of the invention in conjunction with the accompanying figures.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, which are incorporated herein and constitute part of this specification, illustrate exemplary embodiments of the invention, and, together with the general description given above and the detailed description given below, serve to explain the features of the invention.

DETAILED DESCRIPTION OF THE INVENTION

Definitions

Figure 1:
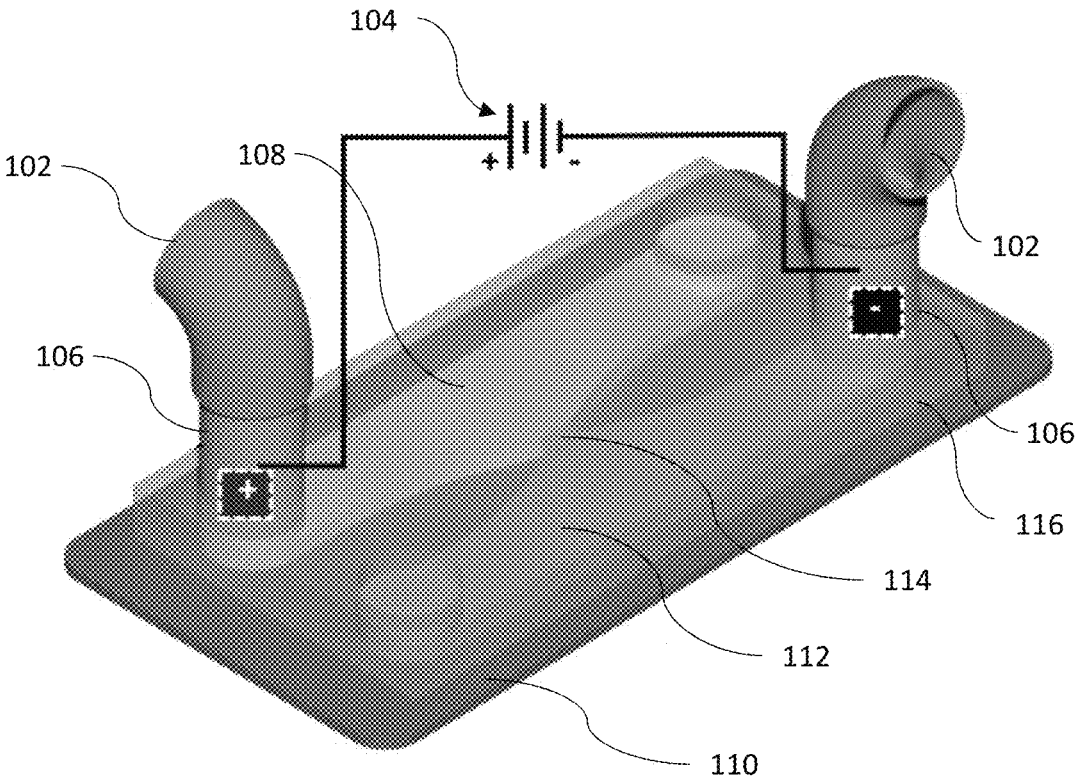
FIG. 1 is a graph showing the schematic of the electrofabrication across an aperture between two microchannels according to an exemplary embodiment of the present disclosure.

Where the definition of terms departs from the commonly used meaning of the term, applicant intends to utilize the definitions provided below, unless specifically indicated.

Unless defined otherwise, all technical and scientific terms used herein have the same meaning as is commonly understood to which the claimed subject matter belongs. In the event that there is a plurality of definitions for terms herein, those in this section prevail. All patents, patent applications, publications and published nucleotide and amino acid sequences (e.g., sequences available in GenBank or other databases) referred to herein are incorporated by reference. Where reference is made to a URL or other such identifier or address, it is understood that such identifiers can change and particular information on the internet can come and go, but equivalent information can be found by searching the internet. Reference thereto evidences the availability and public dissemination of such information.

It is to be understood that the foregoing general description and the following detailed description are exemplary and explanatory only and are not restrictive of any subject matter claimed. In this application, the use of the singular includes the plural unless specifically stated otherwise. It must be noted that, as used in the specification and the appended claims, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

For purposes of the present disclosure, the term "comprising", the term "having", the term "including," and variations of these words are intended to be open-ended and mean that there may be additional elements other than the listed elements.

For purposes of the present disclosure, directional terms such as "top," "bottom," "upper," "lower," "above," "below," "left," "right," "horizontal," "vertical," "up," "down," etc., are used merely for convenience in describing the various embodiments of the present disclosure. The embodiments of the present disclosure may be oriented in various ways. For example, the diagrams, apparatuses, etc., shown in the drawing figures may be flipped over, rotated by 90° in any direction, reversed, etc.

For purposes of the present disclosure, a value or property is "based" on a particular value, property, the satisfaction of a condition, or other factor, if that value is derived by performing a mathematical calculation or logical decision using that value, property or other factor.

For purposes of the present disclosure, it should be noted that to provide a more concise description, some of the quantitative expressions given herein are not qualified with the term "about." It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

For purposes of the present disclosure, the terms "elactrodeposition" refers to a broad range of industrial processes which includes electrocoating, e-coating, cathodic electrodeposition, anodic electrodeposition and electrophoretic coating, or electrophoretic painting. It is a conventional process of coating a thin layer of materials on conducting electrode surfaces to modify its surface properties by passing a current through an electrochemical cell from an external source. It is a versatile technique for the preparation of thin films of metals, metallic alloys, and compounds, the electrodeposited materials grow from the conductive substrate outward, and the geometry of the growth can be controlled using an insulating mask (so-called through-mask electrodeposition). The conventional elactrodeposition has several limitations, among which the material deposition only happens on the conductive substrate, and the conductive substrate is normally part of the final product.

For purposes of the present disclosure, the terms "electroplating" refers to processes that create a metal coating on a solid substrate through the reduction of cations of that metal by means of a direct electric current. The part to be coated acts as the cathode (negative electrode) of an electrolytic cell; the electrolyte is a solution of a salt of the metal to be coated; and the anode (positive electrode) is usually either a block of that metal, or of some inert conductive material. The current is provided by an external power supply. The limitations of these processes include that the material deposition only happens on the cathode surface, and the cathode is part of the final product.

For purposes of the present disclosure, the terms "polyelectrolyte complex membrane" refers to membrane made of materials formed by combining oppositely charged polyelectrolytes (PEs) together via ionic interaction.

For purposes of the present disclosure, the terms "w/v", "w/v %" and "% w/v" are used interchangeably. These terms refer to Mass concentration of a solution, which is expressed as weight per volume.

For purposes of the present disclosure, the terms "microchannel" refers to an opening with a width or diameter of less than 1 mm.

For purposes of the present disclosure, the terms "open space" refers to an opening with a width or diameter larger than that of microchannel. The term "open space" in the present disclosure is used as an opposite to "microchannel".

Description

In one embodiment, an electrofabricating freestanding chitosan membrane is formed at the interface of polyelectrolytes without electrodes at the fabrication site, using interfacial electrofabrication.

In one embodiment, the instantaneous flow of hydroxyl ions in the alginate solution, instead of the slower migration of pH gradients as in the electrodeposition of chitosan on the cathode surfaces, is responsible for growing the freestanding membrane structure in electrolyte with distal electrodes.

In one embodiment, the interfacial electrofabrication is applicable to the interface of various materials and presents a new direction in using electrical signals for manufacturing.

Electrofabrication of Freestanding Chitosan Membrane

In one embodiment, the interfacial electrofabrication of a chitosan membrane can be formed in polydimethylsiloxane (PDMS) microchannels with distal electrodes. The interfacial electrofabrication is demonstrated in polydimethylsiloxane (PDMS) microchannels as schematically shown in FIG. 1. As shown in FIG. 1, the electrofabrication comprises two capillary tubings 102, each of which connected to a metal coupler 106, a DC power supply 104, and PDMS 116 on a glass slide 110. The two metal couplers 106 function as distal electrodes, with one anode and one cathode. Therefore, the two metal couplers 106 at the channel terminals function as both capillary connectors and distal electrodes. The DC power supply 104 connects the two distal electrodes. The positively charged chitosan solution 108 is also placed on the glass slide 110 and in connection with the positive electrode, while the negatively charged alginate solution 112 is also placed on the glass slide 110 and is in connection with the negative electrode. The chitosan solution 108 and alginate solution 112 come in touch at the microchannel formed by PDMS, where the chitosan membrane 114 forms.

Figure 2:
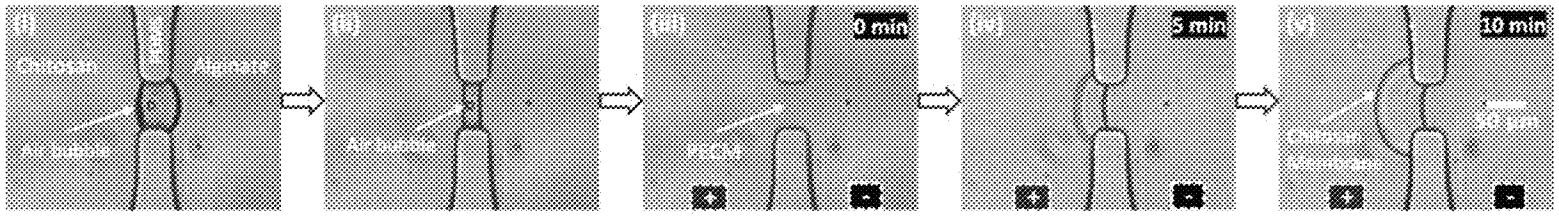
FIG. 2 is photos showing the sequence of the interfacial electrofabrication in microfluidics according to an exemplary embodiment of the present disclosure.

In one embodiment, the interfacial electrofabrication of chitosan membrane comprises a sequence of stages. The sequence of the interfacial electrofabrication in microfluidics between chitosan (0.5% w/v, pH 5.3) and alginate (0.5% w/v, pH 6) solutions at 60 $A/m^2$ applied current density is shown in FIG. 2. According to FIG. 2. these sequential stages include: panel (i) the trapping of an air bubble in the PDMS microchannel, panel (ii) the vacuuming of the air bubble out of the microchannel network, panel (iii) the formation of the PECM, panel (iv) the growth of the chitosan membrane on the PECM to 30 μm thick in 5 minutes, and panel (v) the final membrane at 56 μm thick in 10 minutes. In one embodiment, no current was added in the stages shown in panels (i) and (ii) of FIG. 2.

In one embodiment, after the air bubble trapped inside the aperture was extracted out of the PDMS microchannel, the positively charged chitosan and negatively charged alginate chains/solutions came into contact electrostatically and formed a polyelectrolyte complex membrane (PECM) at the interface between the two solutions, which is consistent with previous reports.[41, 42]

Figure 3:
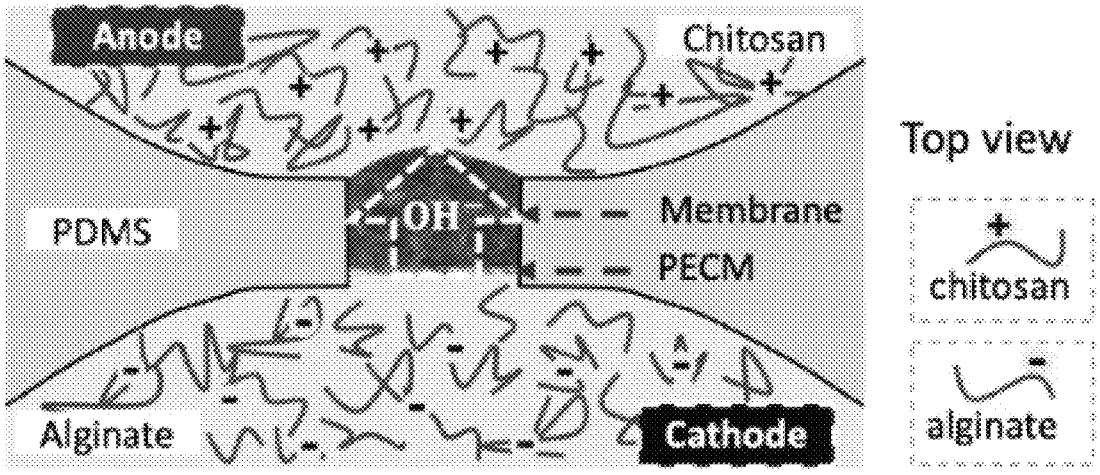
FIG. 3 is a graph showing the schematic top views of the chitosan membrane growth according to an exemplary embodiment of the present disclosure.
Figure 4:
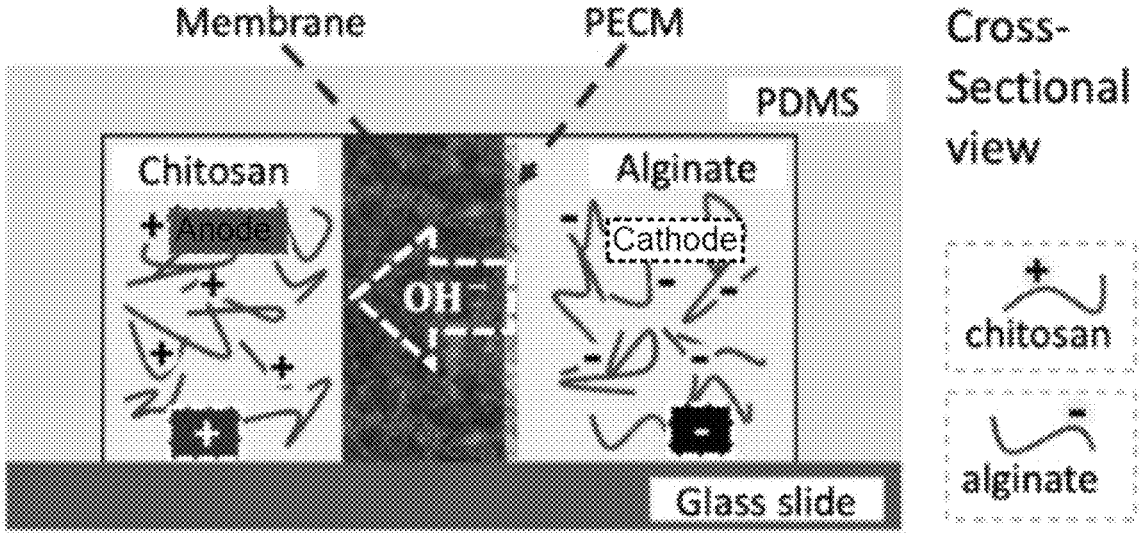
FIG. 4 is a graph showing the schematic cross-sectional views of the chitosan membrane growth according to an exemplary embodiment of the present disclosure.

In one embodiment, after the air bubble trapped inside the aperture was extracted out of the PDMS microchannel, a constant direct current was applied. When a constant direct current was applied through the distal electrodes, the positively charged chitosan chains in the applied electrical field migrated toward the cathode, which was similar to gel electrophoresis. Since the chitosan and alginate biopolymer chains were too large to cross the PECM, they were stopped at the PECM. Chitosan chains were then deprotonated by hydroxyl ions from the alginate side and solidified as a membrane structure, while alginate chains, with a pKa value in the range of 3.4 to 4.4, remained intact. The growth of the chitosan membrane is illustrated in FIGS. 3 and 4, with FIG. 3 presenting a top view and FIG. 4 presenting a cross-sectional view.

In one embodiment, the PECM was formed in a spontaneous, flexible, and controlled manner, which offers boundless potential for applications in bioelectronics, biomedical field and more.

Many experimental parameters may affect the interfacial electrofabrication of chitosan membranes. In one embodiment, these parameters include but are not limited to the applied current density, the current connection time, the pH and concentration of chitosan and alginate solutions, and additional components such as chloride and sodium ions in the chitosan solution.

Figure 5:
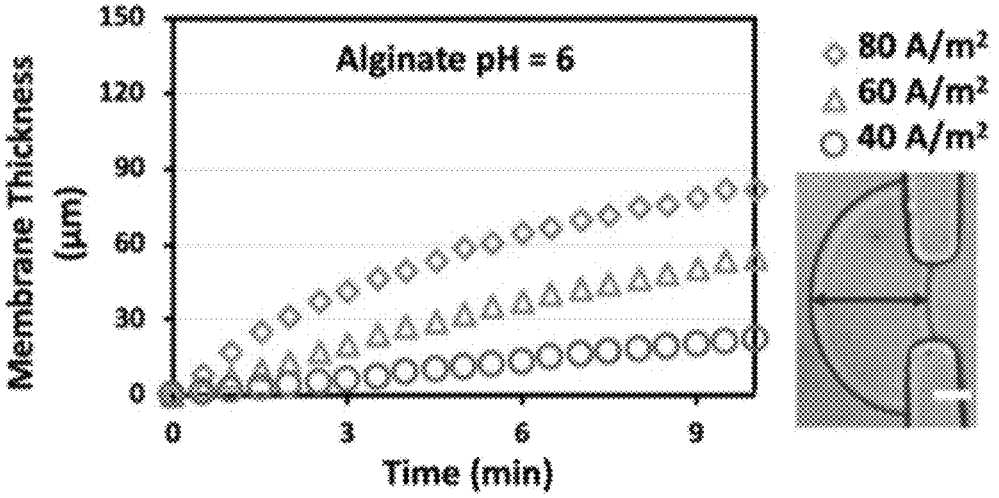
FIG. 5 is a graph showing the time-dependent membrane thickness as a function of current density (40, 60 and 80 $A/m^2$) at pH of 6 according to an exemplary embodiment of the present disclosure.
Figure 6:
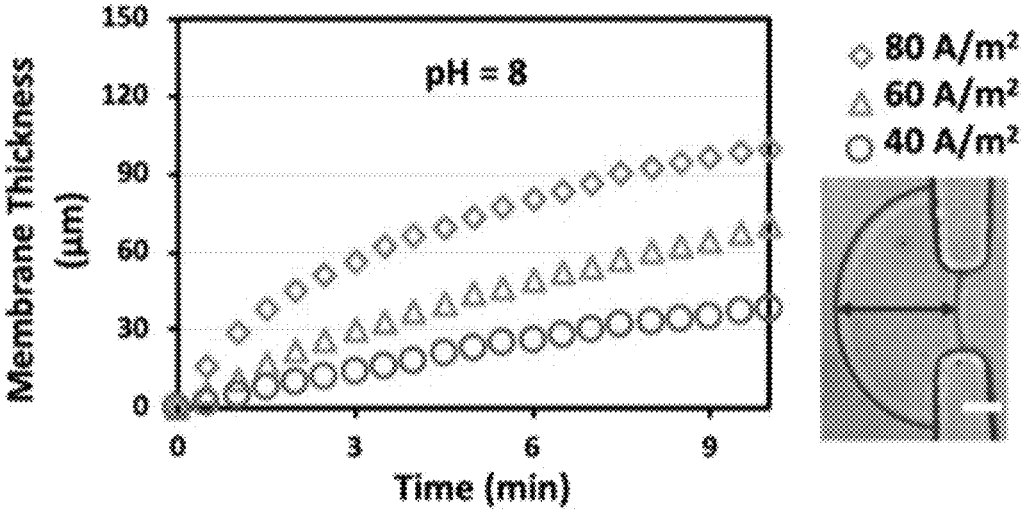
FIG. 6 is a graph showing the time-dependent membrane thickness as a function of current density (40, 60 and 80 $A/m^2$) at pH of 8 according to an exemplary embodiment of the present disclosure.
Figure 7:
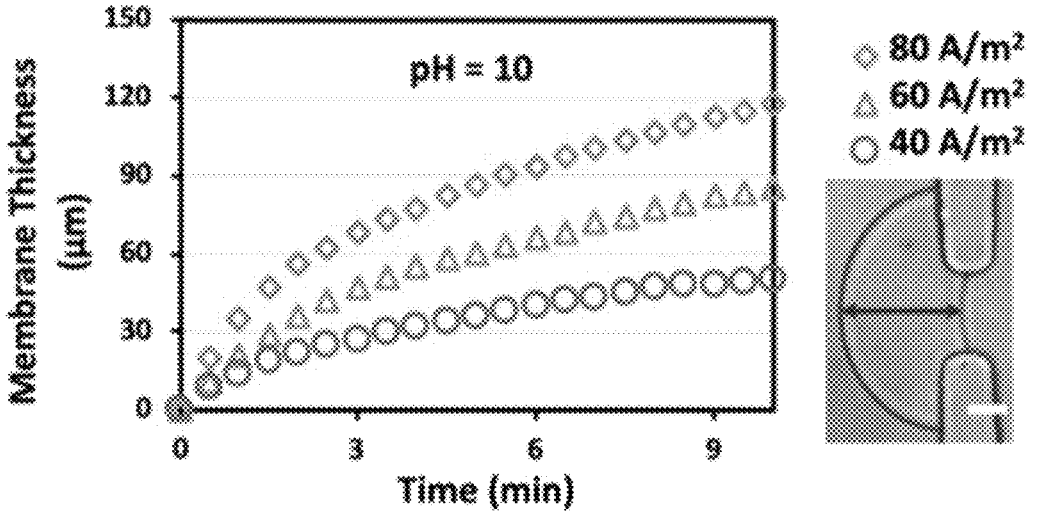
FIG. 7 is a graph showing the time-dependent membrane thickness as a function of current density (40, 60 and 80 $A/m^2$) at pH of 10 according to an exemplary embodiment of the present disclosure.
Figure 8:
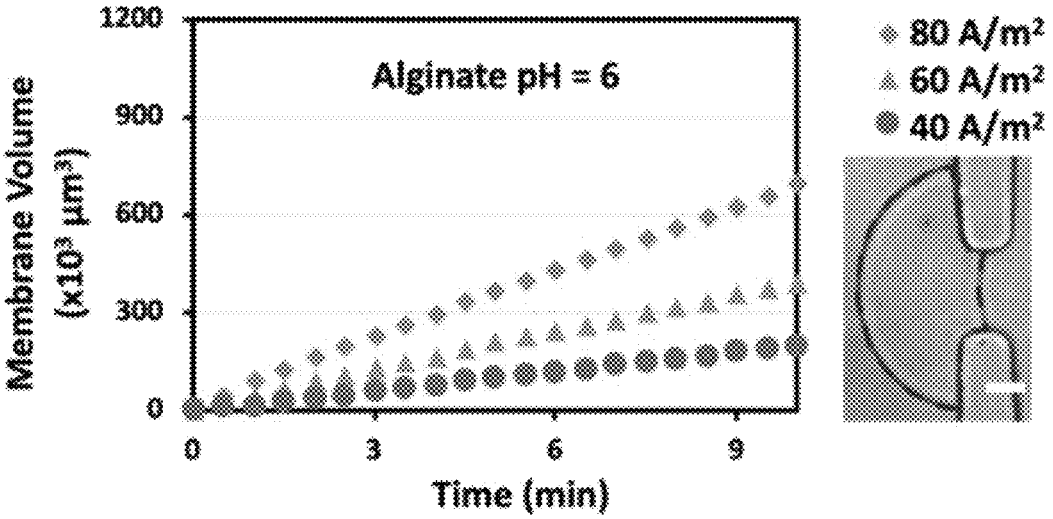
FIG. 8 is a graph showing the time-dependent membrane volume as a function of current density (40, 60 and 80 $A/m^2$) at pH of 6 according to an exemplary embodiment of the present disclosure.
Figure 9:
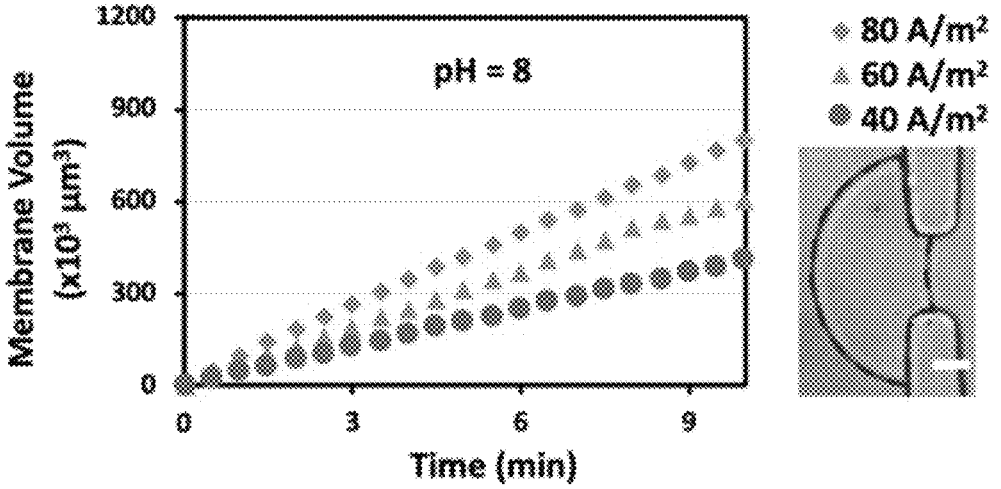
FIG. 9 is a graph showing the time-dependent membrane volume as a function of current density (40, 60 and 80 $A/m^2$) at pH of 8 according to an exemplary embodiment of the present disclosure.
Figure 10:
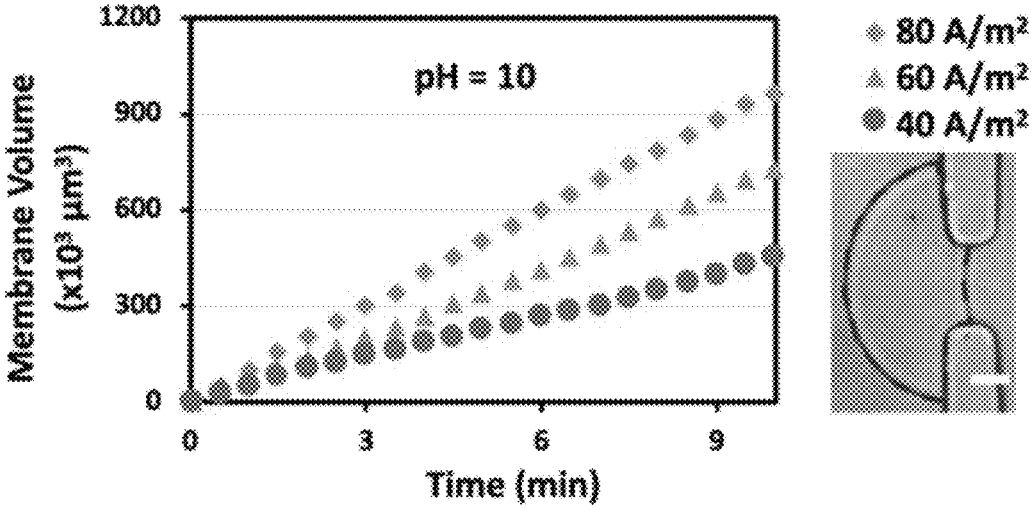
FIG. 10 is a graph showing the time-dependent membrane volume as a function of current density (40, 60 and 80 $A/m^2$) at pH of 10 according to an exemplary embodiment of the present disclosure.

In one embodiment, the effects of three key parameters including (i) fabrication time, (ii) current density, and (iii) the pH level of alginate solution were characterized while the pH of chitosan remained at 5.3. In another embodiment, the pH of chitosan solution is 5.0 to 6.0, because the pKa value of chitosan is 6.3. If the pH of chitosan solution is higher than 6.0, the uniformity of solution would be destroyed due to partial gelation. If the pH is lower than 5, the formed chitosan membrane would be dissolved when the surrounding pH is too low. FIGS. 5-7 show the time-dependent growth of the membrane thickness as functions of current density (40, 60, and 80 $A/m^2$) with the alginate solution of pH 6 (FIG. 5), pH 8 (FIG. 6), and pH 10 (FIG. 7). FIGS. 8-10 show the time-dependent growth of the membrane volume as functions of current density (40, 60, and 80 $A/m^2$) with the alginate solution of pH 6 (FIG. 8), pH 8 (FIG. 9), and pH 10 (FIG. 10). As shown in FIG. 5-10, these results clearly show that: (1) the higher the applied current density, the faster the membrane grew; (2) the higher the pH of alginate solution, the faster the membrane grew as shown; (3) the growth curves of the membrane thickness in FIGS. 5-7 were nonlinear in the first three minutes, presumably due to the irregular membrane shape from inside the aperture into the microchannel; but importantly, (4) the growth curves of the membrane volume (membrane area times channel height) were almost linear throughout the ten minutes.

In one embodiment, the alginate solution has a pH of 4-11. Alginate becomes gel-like at pH around 3.5. Thus, the pH of alginate solution should be maintained above 5 to keep fluidic properties for electrofabrication. If the pH of alginate solution is higher than 11, the formation of chitosan membrane would be spontaneously induced by ph gradient instead of current.

In one embodiment, the interfacial electrofabrication is programmable with current density, solution pH and time, and the process is simple and robust. For instance, with pH 8 alginate solution as shown in FIG. 9, the volume growth rates, represented by the slopes of line fits of the curves, were 41.3, 62.5 and $82.3\times10^3$ $\mu m^3$/min for the current density of 40, 60, and 80 $A/m^2$, respectively. Theoretically, chitosan chains of similar molecular weight in a constant electric filed should migrate at a similar rate, which explains the almost linear growth curves of the membrane volume over time.

In one embodiment, the chitosan membranes form in the middle of microchannels without the need of electrodes at the fabrication site, which is novel and potentially important. Therefore the size, type and location of electrodes are no longer important.

In one embodiment, the location of the chitosan membrane was defined by the location of the PECM, which is flexible and controllable by device design and process manipulation.

In a microdevice integrated with electrodes, the electrode fabrication is normally the major portion of the cost. In one embodiment, ex situ, simple and exchangeable electrodes could be repeatedly used with the disposable, cheap PDMS devices.

In one embodiment, the freestanding configuration of the fabricated chitosan membrane offers easy fluidic and electrical access to both sides of the membrane, which is of importance in a myriad of filtration, sampling, and sensing applications in chemical, biochemical, and potentially battery engineering.

Visualization of Chitosan Chains' Migration

Figure 11:
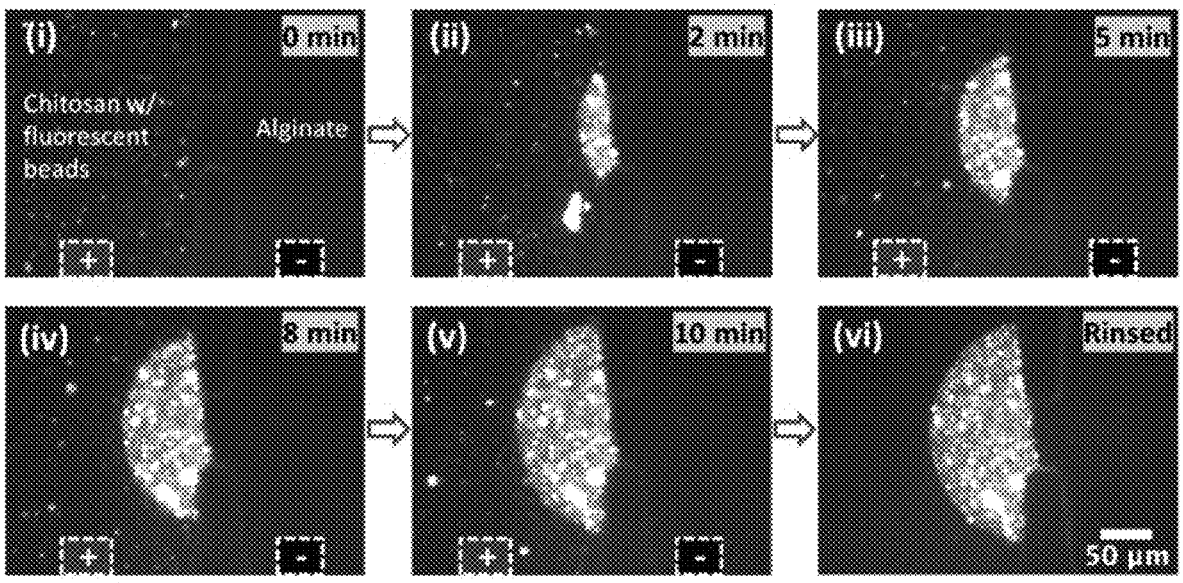
FIG. 11 is a photo showing the sequence of co-deposition of a chitosan membrane with fluorescent beads according to an exemplary embodiment of the present disclosure.

In one embodiment, the migration and deposition of chitosan chains onto the PECM is visualized using green fluorescent polystyrene beads. In a recent report about flow-assembly of chitosan membrane with polystyrene beads, the non-charged beads trapped in chitosan chains moved along with chitosan chains to form highly aligned chitosan-polystyrene composite membranes.[46] The green fluorescent polystyrene beads of 200 nm in diameter were mixed in chitosan solution at the concentration of 0.2 mg/mL. The electrofabrication of the chitosan-beads mixture at 60 $A/m^2$ current density for ten minutes is shown in FIG. 11. Here, it was clearly observed that the electrically neutral fluorescent particles were taken along by the entangling chitosan chains and packed in the chitosan membrane on the PECM, as shown in FIG. 11. In FIG. 11, panels (i)-(v) show the sequence of the co-deposition of a chitosan membrane with 200-nm fluorescent beads at 60 $A/m^2$ over 10 minutes to visualize the migration and deposition of chitosan chains onto PECM, while panel (vi) shows the final deposited chitosan membrane with fluorescent beads after rinsing with PBS. When the applied current was off, chitosan solution could be easily washed away while the fabricated chitosan membrane with entrapped fluorescent particles remained intact.

Figure 12:
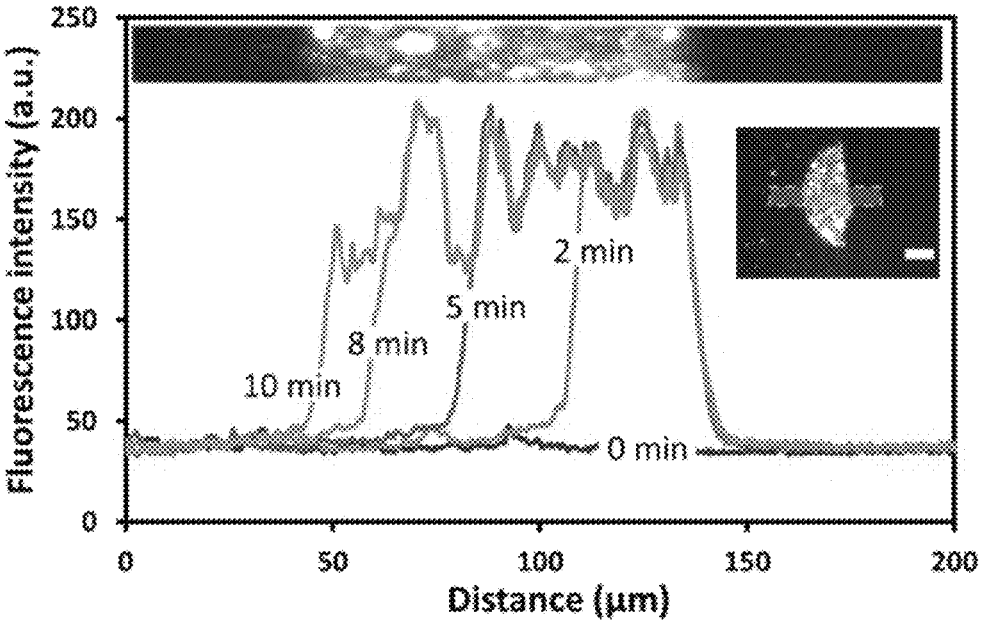
FIG. 12 is a graph showing the time course profiles of the fluorescence intensity of the deposited membrane with embedded fluorescent beads according to an exemplary embodiment of the present disclosure.

In one embodiment, the locations of entrapped particles did not change over time, and speed of the moving particles before reaching the fabricated chitosan membrane was not obviously slowed down, indicated by the fluorescence intensities over time through a fixed section of the membrane analyzed and plotted in FIG. 12.

In one embodiment, the size of fluorescent spots was not uniform because of bead aggregation.

Figure 13:
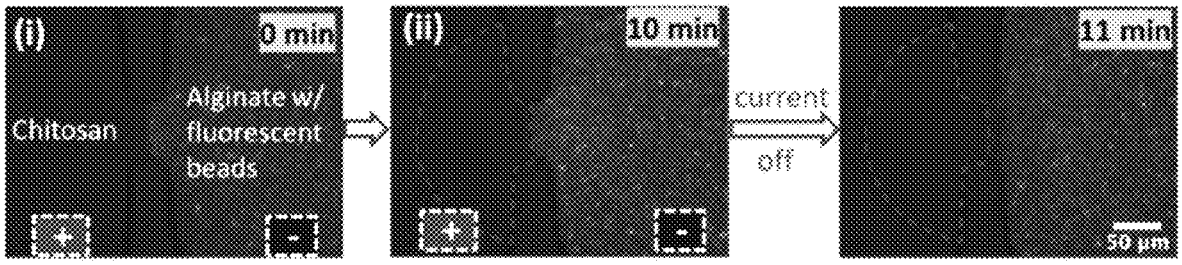
FIG. 13 is a photo showing the migration of alginate chains during the electrofabrication according to an exemplary embodiment of the present disclosure.

In one embodiment, the green fluorescent polystyrene beads of 200 nm in diameter were mixed in alginate solution at the concentration of 0.2 mg/mL. FIG. 13 shows the sequence of the deposition of a chitosan membrane at 60 $A/m^2$ over 10 minutes to visualize the migration of green fluorescent polystyrene beads entangled with alginate chains. As shown in FIG. 13, the fluorescent beads were initially taken along by the entangling alginate chains and accumulated near the PECM, then the tracking speed was slowed down quickly. When the applied current was off, the accumulated fluorescent beads were released back to the original uniform distribution as shown in right panel of FIG. 13. This was different from when the green fluorescent polystyrene beads were mixed with the chitosan solution, in which the beads were fixed in the chitosan membrane formed even after the current was off. Apparently, the negatively charged alginate chains were attracted toward the anode under the electrical field and were relaxed without gel formation once the electrical force disappeared.

Figure 14:
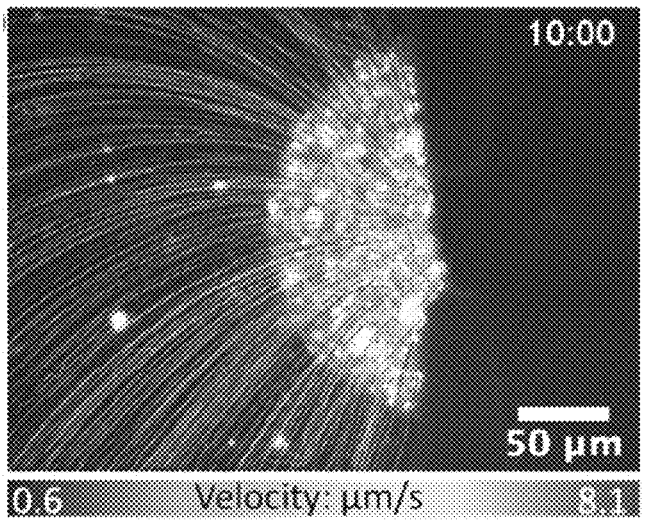
FIG. 14 is a photo showing the migration paths of fluorescent beads in 10 mins during the electrofabrication according to an exemplary embodiment of the present disclosure.

In one embodiment, the migration paths of fluorescent particles together with chitosan chains in were analyzed and plotted, using TrackMate from Fiji.[47] FIG. 14 shows the migration paths of fluorescent particles. As shown in FIG. 14, the migration paths of fluorescent particles also depicts the virtual electric field lines.

In one embodiment, the particle movement in the chitosan solution was a proxy for the chitosan chain migration, because there was no or minimum fluorescent particle migration when chitosan was removed from the solution (data not shown).

In one embodiment, the overall motion paths were originated from where the anode was inserted.

In one embodiment, the anode was inserted at the lower left corner of the view shown in FIG. 14 in the chitosan solution. Therefore, the overall motion paths were originated from the lower left corner and were not symmetric.

In one embodiment, the migration paths shown in FIG. 14 are color-coded with the mean velocity of each bead. Therefore, the velocities of individual fluorescent particles throughout ten minutes can be tracked. The velocities of individual fluorescent particles at each time point are shown in FIG. 15, indicated as the blue dots.

Figure 15:
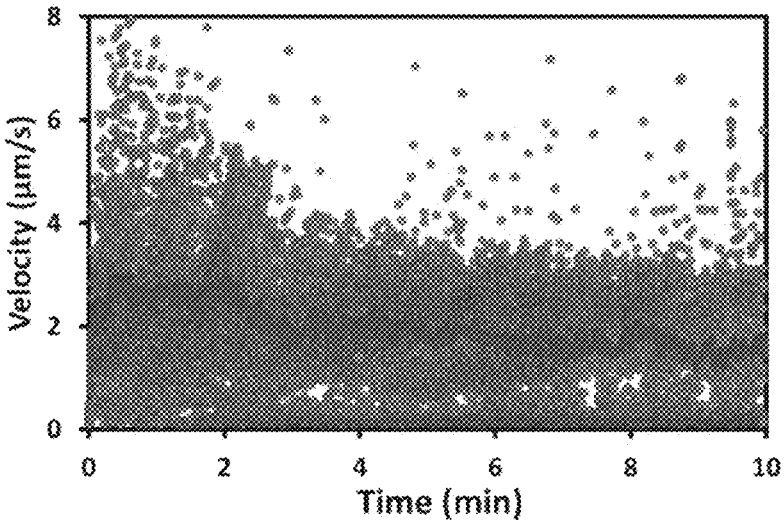
FIG. 15 is a graph showing the velocity of each bead and the average velocity of all beads in each time frame according to an exemplary embodiment of the present disclosure.

In one embodiment, the average velocity of the chitosan chain movement was nearly constant at a rate of about 2 μm/sec throughout the deposition process, as shown in FIG. 15. In FIG. 15, the average velocity of all beads at each time frame is indicated by the red curve.

Figure 16:
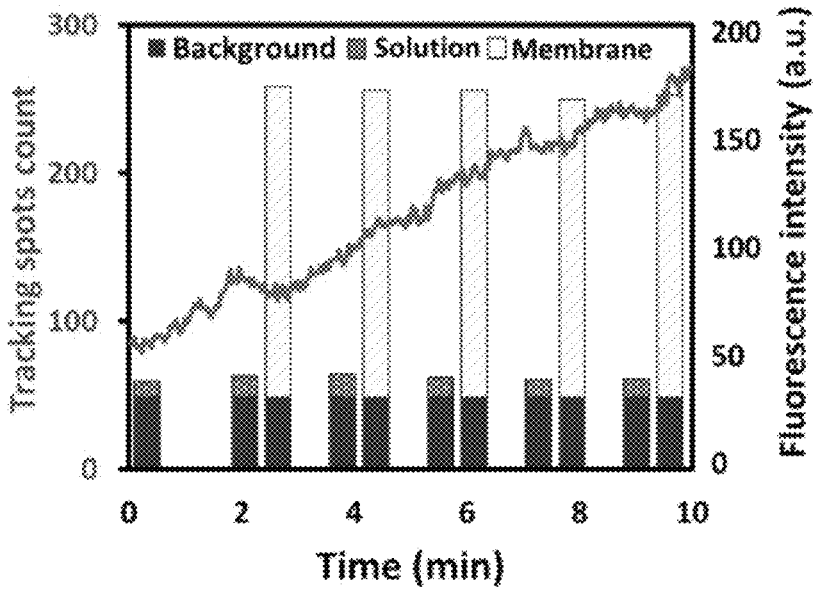
FIG. 16 is a graph showing the count of tracking spots in 10 mins according to an exemplary embodiment of the present disclosure.

In one embodiment, the number of tracking particles within the viewing region increased almost linearly, as shown by the curve in FIG. 16. The nearly linear increase of the number of tracking particles is consistent with the linear growth of membrane volume shown in FIGS. 8-10.

FIG. 16 also shows the average fluorescence intensity of background (black), chitosan solution (meshed) and chitosan membrane (slashed) with fluorescent beads. In one embodiment, the average fluorescence intensities of the chitosan membrane and the chitosan solution remained the same at 170 and 40, respectively, in arbitrary unit (a.u.) throughout the fabrication process, while the background fluorescent signal was 32. Based on absolute fluorescence signals, the number of fluorescent particles in chitosan membrane was about 17 times of that in chitosan solution. In one embodiment, the concentration of chitosan solution was 0.5% (w/v). Therefore, the electrofabricated chitosan membrane at the current density of 60 $A/m^2$ contained about 8.5% (w/v) chitosan.

Figure 17:
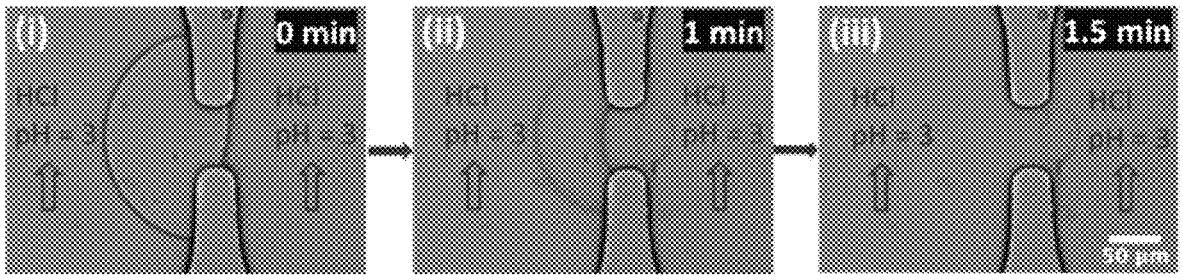
FIG. 17 is a photo showing the sequence of the electrofabricated chitosan membrane being dissolved by flowing HCl solution according to an exemplary embodiment of the present disclosure.

In one embodiment, the fabricated membrane except the initial PECM layer was chitosan instead of a structure crosslinked with alginate. In one embodiment, the fabricated membrane dissolved after both sides of the fabricated membrane was rinsed with HCl solution (pH=3). It is well-known that chitosan is water-soluble when the surrounding pH value falls below its pKa of 6.3, while alginate is insoluble when pH is lower than its pKa of 3.5. Therefore, if the fabricated membrane contains alginate, it will not be dissolved completely by acidic solution with pH lower than 3.5. FIG. 17 shows that the fabricated membrane except the PECM layer was completely dissolved by mild acidic solution (pH=3) within a couple of minutes, which confirms that the chitosan membrane was fabricated due to neutralization by hydroxyl ions instead of crosslinking by alginate crossed PECM.

Mechanism for Membrane Growth During Electrofabrication

Chitosan electrodeposition on cathode surfaces has been widely explored in the last two decades,[10, 30-38] and the high pH gradient induced by water electrolysis around the cathode was believed to be the underlying mechanism for the chitosan film formation.[30, 32, 36]

Figure 18:
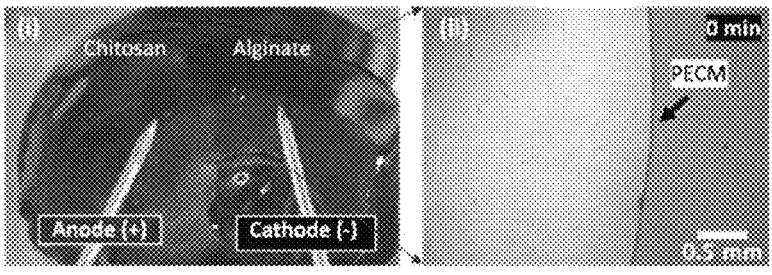
FIG. 18 is a photo showing the electrofabrication configuration in open space with distal electrodes before electrofabrication according to an exemplary embodiment of the present disclosure.
Figure 19:
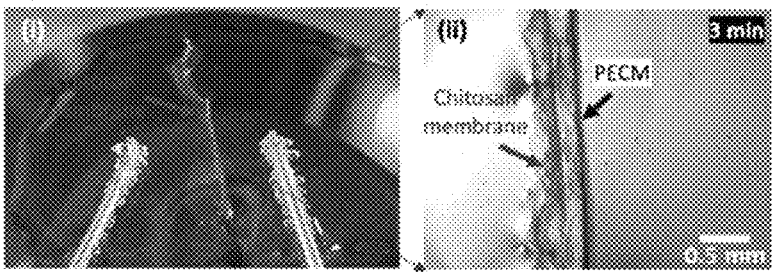
FIG. 19 is a photo showing the electrofabrication configuration in open space with distal electrodes after applying 1 mA current for 3 minutes according to an exemplary embodiment of the present disclosure.

In one embodiment, the electrofabrication was conducted in open space, demonstrating that the electrofabrication is not limited to be inside microchannels and has the potential to be scaled up. The open space configuration of the electrofabrication apparatus is illustrated in FIG. 18. Panel (i) of FIG. 18 shows the open space configuration of the electrofabrication apparatus before electrofabrication. As shown in panel (i) of FIG. 18, chitosan and alginate solution drops were placed side by side on a glass slide on microscope stage with two immerged electrodes away from the solution interface. Panel (ii) of FIG. 18 is a zoom-in view of the PECM interface between solutions. FIG. 19 shows the chitosan membrane growth after applying 1 mA current for 3 minutes. As shown in panel (i) of FIG. 19, a chitosan membrane was grown along PECM, and electrolytic gas bubbles were visible on the electrodes. Panel (ii) of FIG. 19 is a zoom-in view of the membrane of about 0.6 mm thick along PECM.

In one embodiment, the growth of chitosan membrane was due to the immediate flow of hydroxyl ions from the nearby alginate solution right upon applying electrical signal, rather than the slow migration of the high pH gradient from the cathode surface.

In one embodiment, the chitosan membrane has high pH than the chitosan solution and the alginate solution. The pH changes were monitored with two separate pH indicators: phenol red indicating yellow to red colors for pH 6.8 to 8.2, and xylenol blue indicating yellow to blue colors for pH 8.0 to 9.6.

Figure 20:
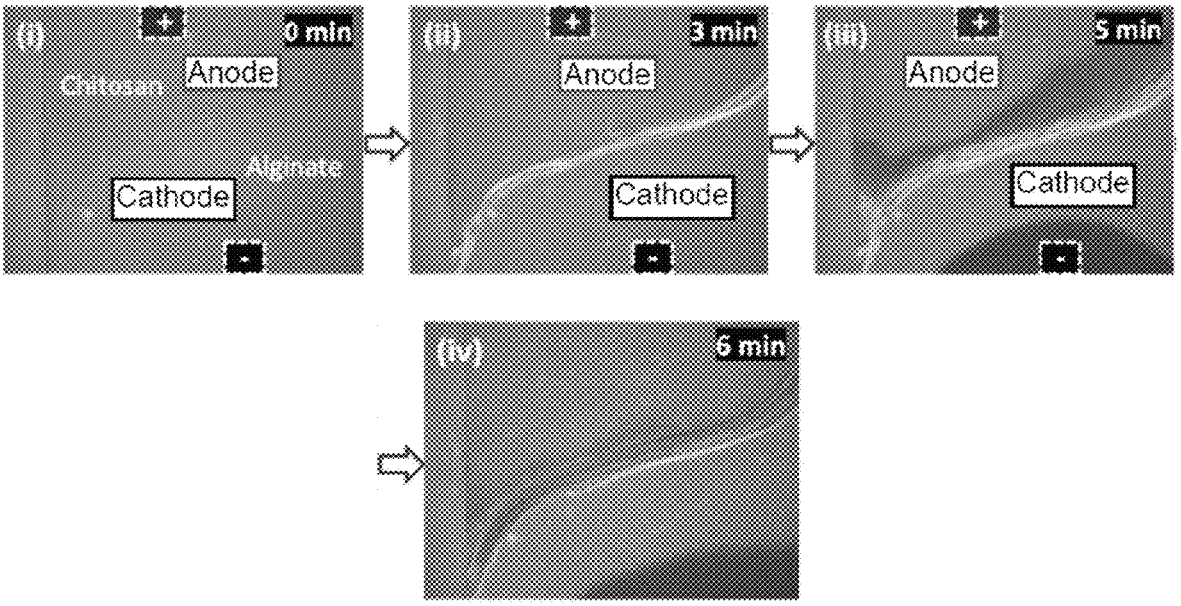
FIG. 20 is a photo showing real-time color and pH changes indicated with phenol red around the solution interface during electrofabrication according to an exemplary embodiment of the present disclosure.
Figure 21:
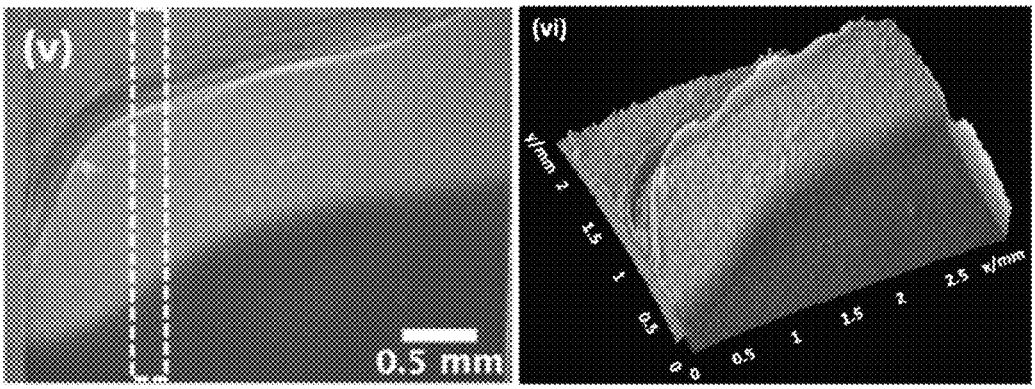
FIG. 21 is a photo showing a re-focused view of the fabricated membrane and its corresponding 3D surface plot with pH changes indicated with phenol red according to an exemplary embodiment of the present disclosure.
Figure 22:
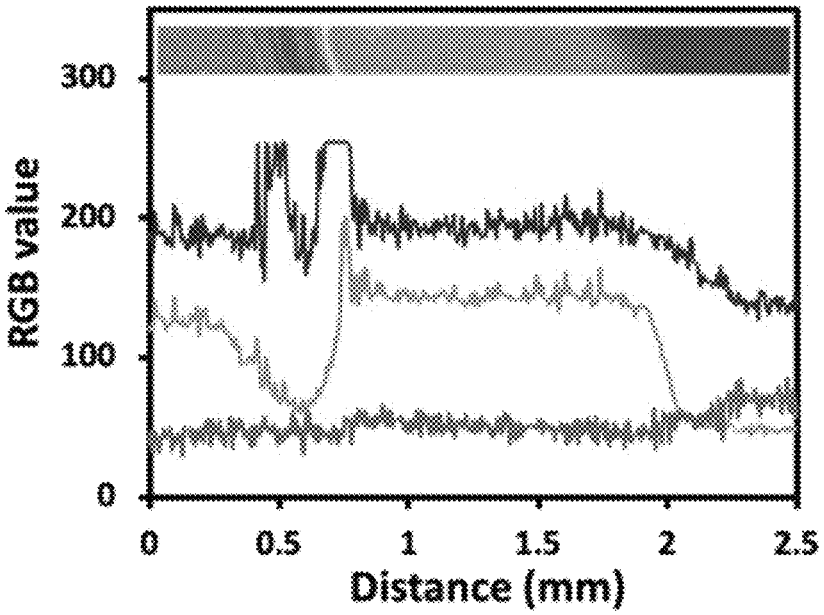
FIG. 22 is a graph showing the RGB spectra of the chitosan membrane with pH changes indicated with phenol red according to an exemplary embodiment of the present disclosure.
Figure 23:
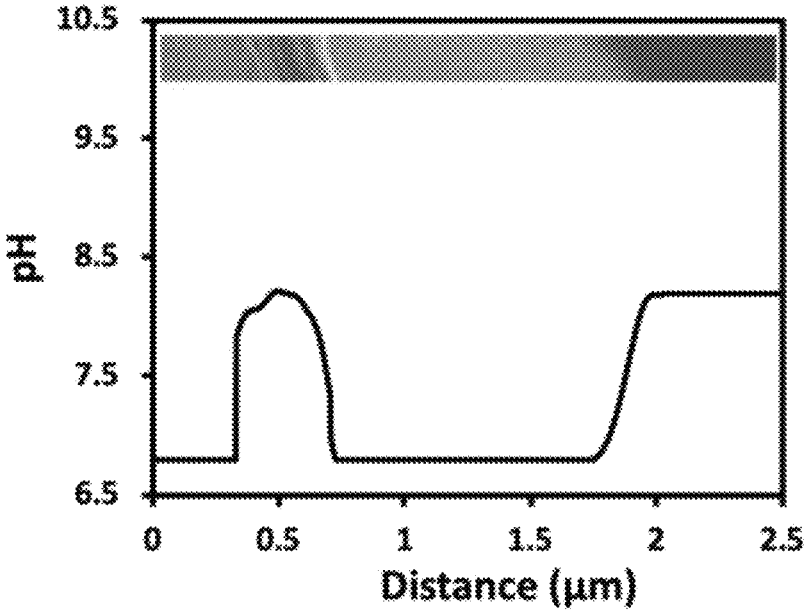
FIG. 23 is a graph showing the pH profile of the chitosan membrane with pH changes indicated with phenol red according to an exemplary embodiment of the present disclosure.

FIG. 20 shows the colors of phenol red at the 0, 3, and 5-minute time points during the fabrication process, as shown in panels (i), (ii) and (iii) of FIG. 20, respectively. Panels (iv) of FIG. 20 shows the colors of phenol red at the 6-minute time point right after the current disconnection. FIG. 21 shows a refocused view of the membrane as in panel (v) of FIG. 21 and its corresponding 3D surface plot with ImageJ as in panel (vi) of FIG. 21. FIGS. 22 and 23 show the RGB spectra and the corresponding pH profile of the selected rectangular segment in panel (v) of FIG. 21. Together, these results confirm that the chitosan membrane started to grow as soon as the electrical current was applied. The growth of chitosan membrane started before the arrival of the high pH gradient from the water electrolysis around the cathode, which is shown as in red color (pH>8.2) in the lower right corners of panels (iii) to (vi) of FIG. 20.

Figure 24:
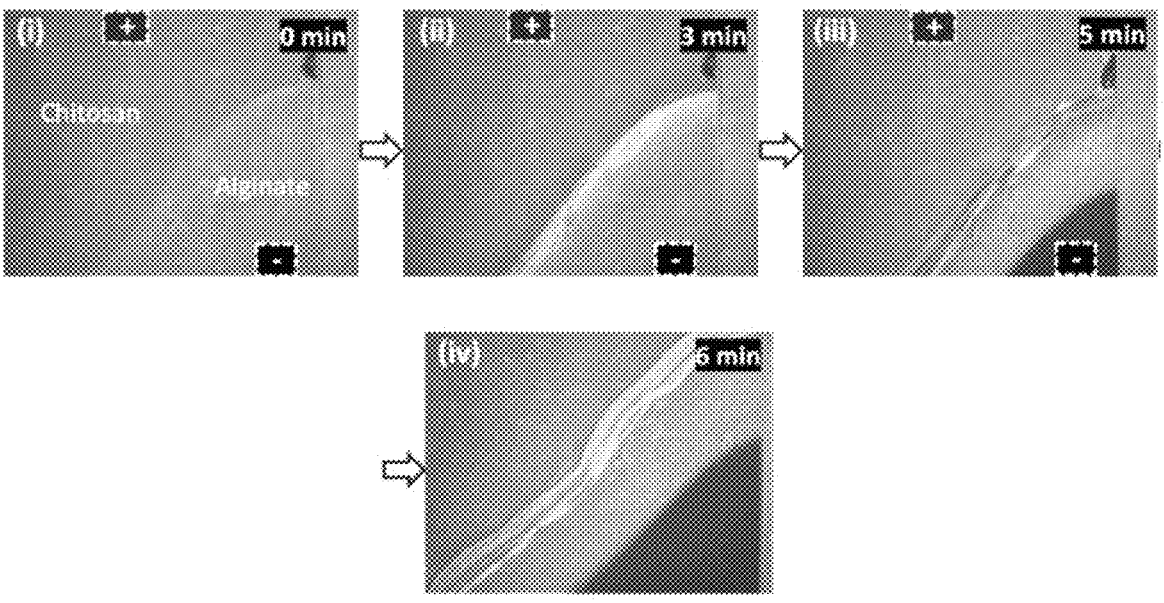
FIG. 24 is a photo showing real-time color and pH changes indicated with xylenol blue around the solution interface during electrofabrication according to an exemplary embodiment of the present disclosure.
Figure 25:
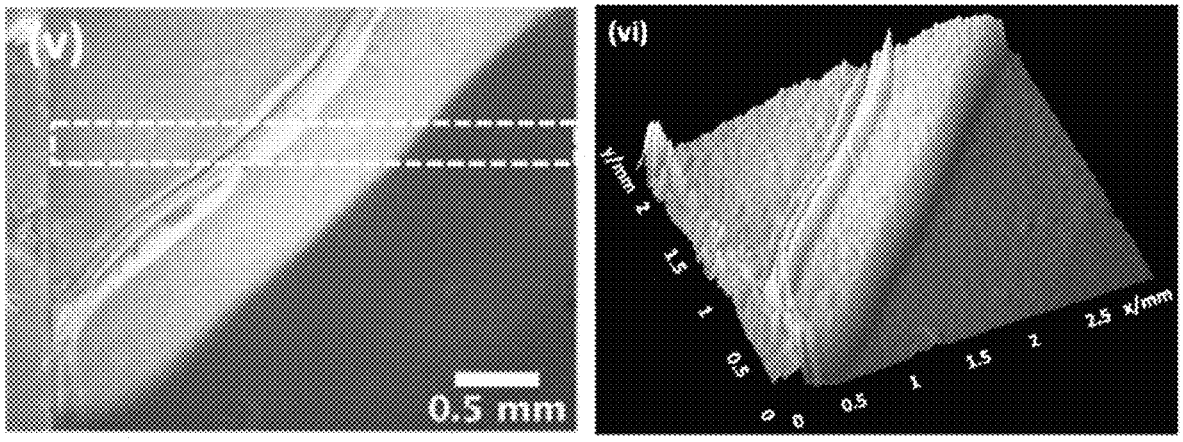
FIG. 25 is a photo showing a re-focused view of the fabricated membrane and its corresponding 3D surface plot with pH changes indicated with xylenol blue according to an exemplary embodiment of the present disclosure.
Figure 26:
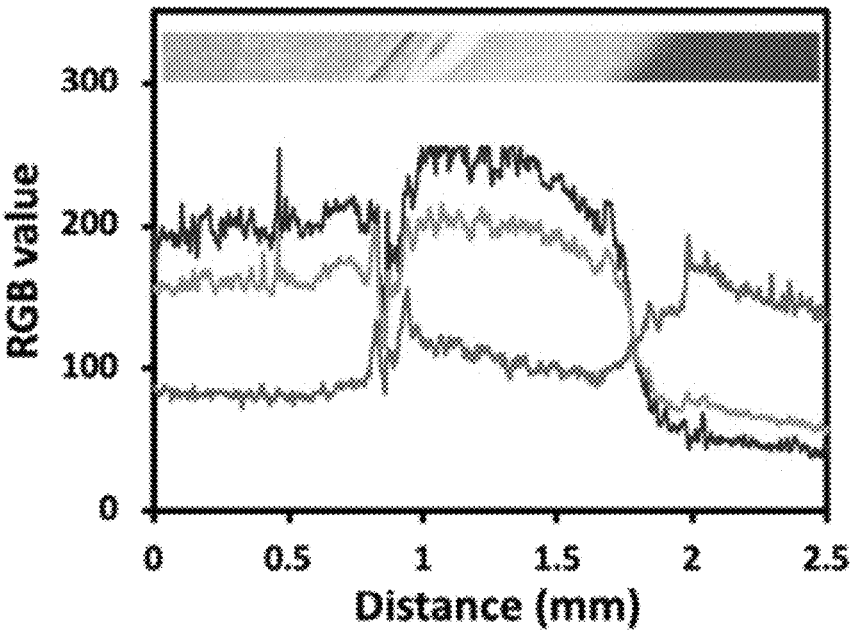
FIG. 26 is a graph showing the RGB spectra of the chitosan membrane with pH changes indicated with xylenol blue according to an exemplary embodiment of the present disclosure.
Figure 27:
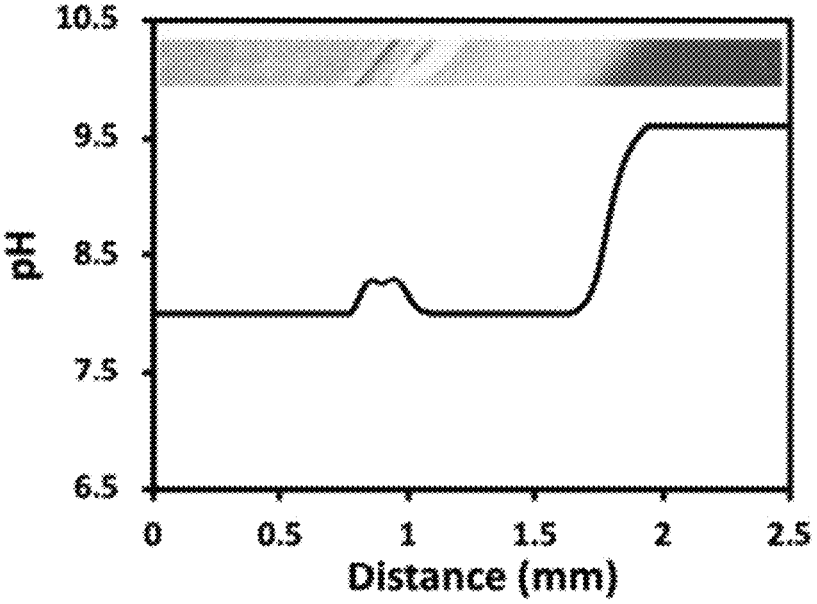
FIG. 27 is a graph showing the pH profile of the chitosan membrane with pH changes indicated with xylenol blue according to an exemplary embodiment of the present disclosure.

Similarly, FIG. 24 shows the colors of xylenol blue at the 0, 3, and 5-minute time points during the fabrication process, as shown in panels (i), (ii) and (iii) of FIG. 24, respectively. Panels (iv) of FIG. 24 shows the colors of xylenol blue at the 6-minute time point right after the current disconnection. FIG. 25 shows a refocused view of the membrane as in panel (v) of FIG. 25 and its corresponding 3D surface plot with ImageJ as in panel (vi) of FIG. 25. FIGS. 26 and 27 show the RGB spectra and the corresponding pH profile of the selected rectangular segment in panel (v) of FIG. 25. Together, these results further confirm that the chitosan membrane started to grow as soon as the electrical current was applied. The growth of chitosan membrane started before the arrival of the high pH gradient from the water electrolysis around the cathode, which is shown as in blue color (pH>9.6) in the lower right corners of panels (iii) to (vi) of FIG. 24.

In one embodiment, although the lower and higher bounds of the pH profiles are different due to the different color spectrum limits of the pH indicators, the pH profile humps around the chitosan membrane have the similar maximum values of pH 8.21 in FIG. 23 and pH 8.28 in FIG. 27.

pH Change in Membrane and Interpretation

In one embodiment, the pH indicator compounds accumulated at the high pH boundaries near the chitosan side when the current was on, which quickly diffused back to the membranes upon current disconnection. For instance, in panel (iii) of FIG. 20, there was a high pH boundaries with accumulation of pH indicator compounds phenol red near the chitosan side indicated as red area nearby the chitosan membranes, which diffused into the membranes as shown in panel (iv) of FIG. 20. For another instant, in panel (iii) of FIG. 24, there was a high pH boundaries with accumulation of pH indicator compounds xylenol blue near the chitosan side indicated as light blue area nearby the chitosan membranes, which diffused into the membranes ash shown in panel (iv) of FIG. 24.

Figure 28:
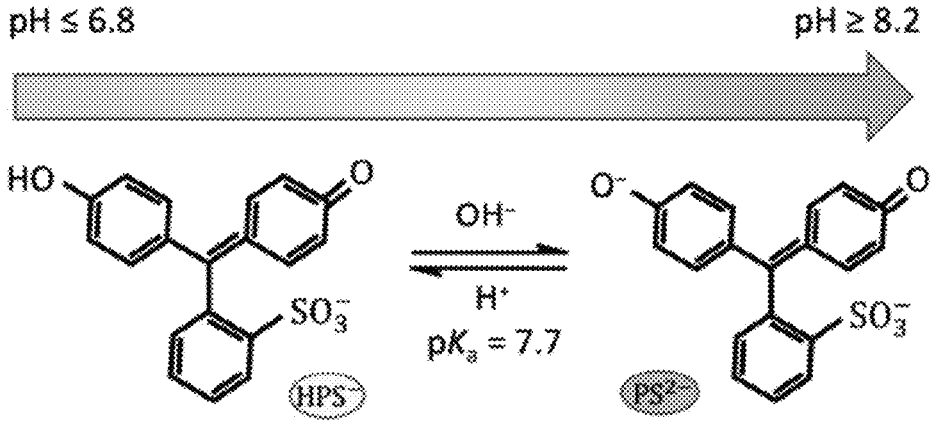
FIG. 28 is an illustration showing the transition of phenol red from yellow (pH≤6.8) to red (pH≥8.0) and its structural change from $HPS^-$ to $PS^{2-}$ according to an exemplary embodiment of the present disclosure.

In one embodiment, the electrofabrication with phenol red was performed in microchannels at 40 $A/m^2$ current density. The molecular structure and color transition of phenol red depending on pH are schematically shown in FIG. 28.

In one embodiment, the high-pH boundary with accumulation of pH indicator compounds moved along with the membrane growth front towards the chitosan solution, but leaving the high-pH interior portion of the chitosan membrane relatively free from accumulation of pH indicator compounds. Once the current was disconnected, the pH indicator compounds accumulated at the high-pH boundary quickly diffused back into the chitosan membrane, indicating the high pH of the whole chitosan membrane.

Figure 29:
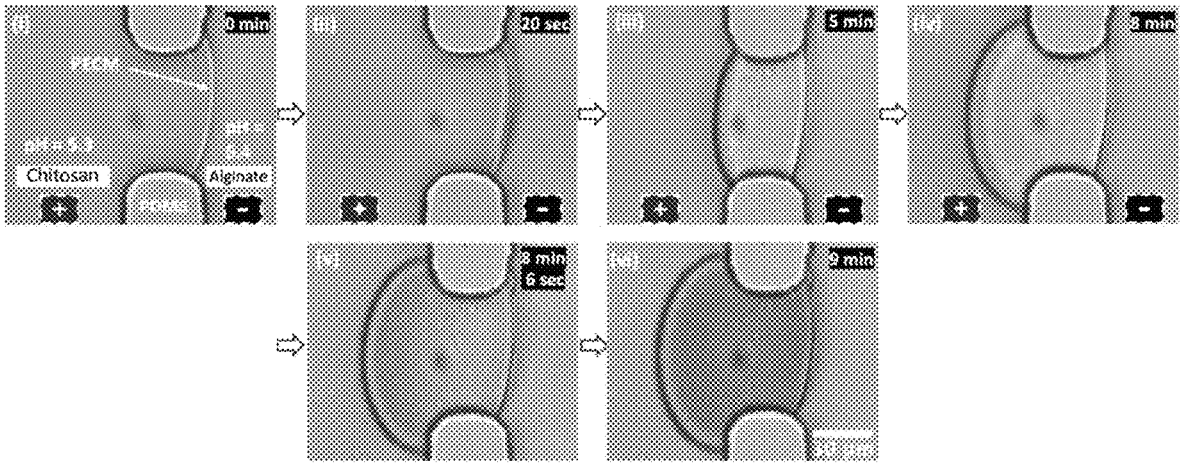
FIG. 29 is a photo showing the color change of phenol red during and after electrofabrication according to an exemplary embodiment of the present disclosure.

FIG. 29 shows the sequential color changes of phenol red during and right after electrofabrication. As shown in FIG. 29, in panel (i) of FIG. 29, no pink boundary indicating lower pH was observed; in panel (ii) of FIG. 29, a pink boundary showed up 20 sec after connecting the current; in panels (iii) and (iv) of FIG. 29, the pink boundary moved along with the membrane growth front towards the chitosan solution but, remarkably, leaving no color inside the chitosan membrane, suggesting significantly more accumulation of phenol red at the growth front than inside the chitosan membrane.

In one embodiment, the distribution of indicator compounds within the whole membrane reached equilibrium after about 1 minute after the disconnection of current. Once the current was disconnected, the obvious pink boundary quickly diffused back into the chitosan membrane, while a weaker pink boundary on the alginate side also diffused into the membrane. As shown in panel (v) of FIG. 29, the pink boundary already diffused inside the chitosan membrane 6 sec after the disconnection of current, while a weaker pink boundary on the alginate side is also visible. After the current was disconnected for 1 min, the chitosan membrane was about uniformly colored with pink, as shown in panel (vi) of FIG. 29.

Figure 30:
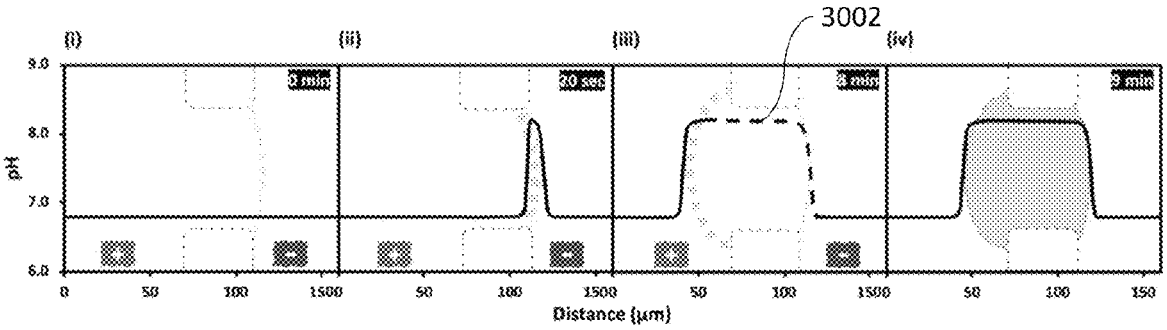
FIG. 30 is a graph showing the sequence of pH profiles during and after electrofabrication according to an exemplary embodiment of the present disclosure.

The corresponding pH profiles at 0 min, 20 sec, and 8 min when the current was on, and 9 min when the current was off, were plotted in FIG. 30. The dash segment 3002 in FIG. 30 indicates the lack of phenol red accumulation in the membrane.

In one embodiment, the lack of pH indicator compounds accumulation, such as phenol red, during the electrofabrication, is due to the rearrangement of negatively charged pH indicator compounds accumulation, such as phenol red, by the electric field and the accumulation of negatively charged $OH^-$ inside the chitosan membrane.

Figure 31:
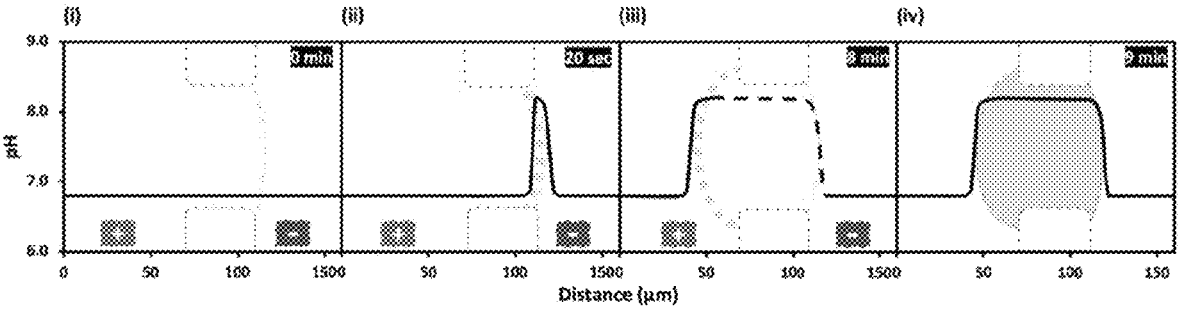
FIG. 31 is a graph showing the schematic distributions of phenol red molecules across the chitosan membrane during electrofabrication according to an exemplary embodiment of the present disclosure.

FIG. 31 schematically shows a plausible explanation of the no color region in membrane. At the onset of electrofabrication, hydroxyl ions preexisting in the alginate polyelectrolyte fluxed to the PECM, as shown in panel (ii) of FIG. 31, which deprotonated the amine groups on chitosan chains with a pKa of 6.3:

$$[—NH_3^+]+[OH^-] \leftrightharpoons [—NH_2]+H_2O \quad (1)$$

Excessive hydroxyl ions also deprotonated the phenol red with a pKa of 7.7;[48]

$$[HPS^-]+[OH^-] \leftrightharpoons [PS^{2-}]+H_2O \quad (2)$$

In one embodiment, the pH of the chitosan membrane increases, as a result of $OH^-$ ions accumulation in the chitosan membrane, wherein the $OH^-$ ions comes from water hydrolysis at the cathode.

The $OH^-$ ions was replenished with the water hydrolysis at the cathode and started to migrate towards the membrane formation site at the electrolyte interface. As the chitosan membrane grew, however, the local accumulation of $OH^-$ ions exceeded the depletion of positively charged amine groups on chitosan, resulting in higher pH inside the membrane than the surrounding electrolyte solution. The excessive accumulation of $OH^-$ ions inside the chitosan membrane potentially acted as a high energy barrier that repelled the $PS^{2-}$ ions to the membrane growth front, and restricted the $HPS^-$ ions in the alginate side from diffusing into the membrane, as shown in panel (iii) of FIG. 31. Became $PS^{2-}$ were more negatively charged than $HPS^-$, more $PS^{2-}$ ions were accumulated at the membrane growth front than the amount of $HPS^-$ ions were trapped at PECM side. When the current was disconnected and the energy barrier in the membrane disappeared, the phenol red molecules diffused back into the membrane. Apparently, the higher amount of $PS^{2-}$ ions at the membrane growth front diffused into the membrane at a higher rate than the relatively lower amount of $HPS^{-}$ ions diffusing from the PECM side, as shown in panel (v) of FIG. 29. The diffusion of phenol red ions reached equilibrium within one minute and the red color was uniform throughout the membrane, as shown in panel (vi) of FIG. 29. In the following few minutes, the $OH^{-}$ ions continued to diffuse out of the membrane and the red color in the membrane slowly fade away.

In one embodiment, no color of pH indicator compounds, such as phenol red, was observed inside the chitosan membrane during the interfacial electrofabrication process, due to the depletion of the negatively charged phenol red molecules.

In one embodiment, the pH level inside the chitosan membrane, however, was the same as that at the membrane growth front, which was around 8.28 as shown in FIGS. 23 and 27.

In one embodiment, the pH level of about 8.28 inside the chitosan membrane makes it suitable for applications with proteins and other biological entities either embedded inside the chitosan membrane or decorated on the membrane surface, so that these biological molecules and entities do not have to experience the high pH gradient environment. High pH environment is normally unavoidable in surface electrodeposition, which is inferior to the presently disclosed freestanding membrane electrofabrication method.

In one embodiment, the electrofabrication can be conducted with constant current densities in the electrolyte. With constant current densities, the neutralization rate of chitosan chains remains constant, and the membrane volume growth rates are also constant.

In another embodiment, the electrofabrication process can be conducted under constant electrical potential.

In another embodiment, the ion transport and the molecular chain migration can be modelled with Nerst-Planck equations.

In another embodiment, the constant electrical field thus the membrane growth rate can be attenuated by salt compositions of various levels.

In another embodiment, the interfacial electrofabrication process may be adjusted by modifying the concentration and molecular weight of chitosan molecules.

Using electrical signals to guide material depositions, in processes such as electroplating or electrodeposition, has a long-standing history in metal coating, electronic chip fabrication, and biomaterial coating. These processes fabricate conductive materials or biomaterials directly onto the cathode surface.

In another embodiment, a novel interfacial electrofabrication without the need of electrodes on the fabrication site is provided for the first time, and the fabrication site is not limited to microchannels as demonstrated in the electrofabrication of larger chitosan membrane in open space.

In one embodiment, this electrofabrication method can integrate biology with devices.

In one embodiment, the location of the chitosan membranes here is defined by where the PECM, which is fluid-fluid polymer electrolyte interface is formed. The formation of PECM is flexible and controllable by the device design and the manipulation of the electrolyte solutions. The location of PECM may be controlled by, for example, polymer composition, pressure balancing between the electrolyte flows, flow rate, fluid viscosity, and longitudinal tention of microchannels.

In one embodiment, the size and location of the chitosan membranes are not limited by the type and size of electrodes, which eases the concern of possible metallic ion contaminations.

In one embodiment, the fabrication process can be further manipulated with simple mesh structures that facilitate the formation of the PECM.

In one embodiment, the process can be extended to the fabrication of other polymers and metals at the interfaces of other fluid phases.

In one embodiment, the freestanding configuration of the fabricated chitosan membranes with easy fluidic and electrical accesses to both sides of the membrane is of importance in a myriad of filtration, sampling, and sensing applications in chemical, biochemical, and battery engineering.

Having described the many embodiments of the present disclosure in detail, it will be apparent that modifications and variations are possible without departing from the scope of the invention defined in the appended claims. Furthermore, it should be appreciated that all examples in the present disclosure, while illustrating many embodiments of the invention, are provided as non-limiting examples and are, therefore, not to be taken as limiting the various aspects so illustrated.

EXAMPLES

Example 1

Solution Preparation

The solution of 0.5% w/v chitosan was prepared by dissolving the chitosan flakes (85% deacetylated, medium molecular weight, Sigma-Aldrich®) in de-ionized (DI) water, with 1 mol HCl added dropwise to pH 2 and left by stirring on a stirring plate overnight, followed by two times of filtration and dropwise addition of 1 mol NaOH to adjust its pH to 5.3. Alginate powder (extracted from brown algae, medium viscosity, Sigma-Aldrich®) was dissolved in DI water at concentration of 0.5% w/w and followed by stirring on a stirring plate overnight, then dropwise addition of 1 mol NaOH to adjust its pH. The pH of the alginate solution was tuned dropwise with 1 mol NaOH or HCl solutions to be 6.0, 8.0 or 10.0 for the experiments measuring the thickness and volume of chitosan membrane, 6.4 for experiments exploring the mechanism of pH change in the chitosan membrane, and 6.0 for the rest of all other experiments. Green fluorescent polystyrene beads of 200 nm in diameter (1 ml of 1% solid suspensions (10 mg/ml) in DI water, Degrader) were suspended in the chitosan and alginate solutions, respectively, at concentration of 0.2 mg/ml. Phenol red indicator (ACS grade, Fisher Scientific®) and xylenol blue indicator (indicator grade, Sigma-Aldrich®) were dissolved in both chitosan and alginate solutions at its maximum solubility 0.77 mg/mL and 0.2 mg/mL, respectively.

Example 2

Interfacial Electrofabrication in Microfluidic Devices

The PDMS microchannels were fabricated using the routine soft lithography technique and bounded with oxygen plasma to glass slides.[42, 44, 49] An aperture of 50 μm in width and height was connected to two 50-μm-deep and 500-μm-wide channels. Two metal couplers (22 ga×8 mm, Instech Laboratories, Inc.), functioning as both capillary connectors and distal electrodes, were inserted into one terminal of each channel, while the other terminals of the channels were left open. After chitosan and alginate solutions were pumped into the microchannels by syringe pumps (NE-1000, New Era Pump Systems, Inc.) at 1 μL/min, an air bubble was naturally trapped in the aperture between the two solutions due to the hydrophobicity of PDMS. The location of the air bubble is indicated in panels (i) and (ii) of FIG. 2. The pumps were stopped, and the air bubble was then vacuumed out of the gas permeable PDMS device with an add-on vacuuming chamber.[41] A polyelectrolyte complex membrane (PECM) was spontaneously formed within the aperture where the positively charged chitosan and negatively charged alginate solutions came into contact. When a direct current of 40, 60 or 80 $A/m^2$ from a power supply (Keithley® 2280S-32-6, Keithley® Instruments) was applied through the distal electrodes, a chitosan membrane was fabricated on PECM between the chitosan (0.5% w/v, pH 5.3) and the alginate (0.5% w/v) solutions. All membranes in microchannels were electrofabricated within 10 minutes while the flows were stopped, and manually rinsed with PBS. The dissolving of electrofabricated chitosan membrane in FIG. 17 was performed by pumping HCl solution (pH=3) at 5 pL/min.

Example 3

Interfacial Electrofabrication in Open Space

To generalize the interfacial electrofabrication without the need of on-site electrodes, experiments in open space were carried out with chitosan and alginate solution drops placed side by side on a glass slide on microscope stage. Two metal electrodes were immerged in the solution drops away from the solution interface, as shown in FIG. 18, while the growth of chitosan membrane was recorded under microscope with a 4× objective. Upon applying a direct current of 1 mA (unspecified current density due to the undetermined area of the electrolyte interface), a chitosan membrane started to form at the PECM interface, while electrolytic gas bubbles were visible on the electrodes panel (i) of FIG. 19. Panel (ii) of FIG. 19 shows the zoom-in view of the chitosan membrane grown in three minutes to about 0.6 mm thick.

Example 4

Interfacial Electrofabrication with pH Indicators

The electrofabrication in open space was further monitored with pH indicators mixed in both chitosan and alginate solutions to reveal the real-time pH change around the fabrication site during electrofabrication. Two pH indicators were used in separate experiments: phenol red of 0.77 mg/mL indicating yellow to red colors from pH 6.8 to 8.2, and xylenol blue of 0.2 mg/mL indicating yellow to blue colors from pH 8.0 to 9.6. The pH levels of the chitosan and alginate solutions were adjusted to 5.3 and 6.0, respectively, for both indicators. To further examine the pH change inside chitosan membrane, interfacial electrofabrication with phenol red in both chitosan (pH=5.3) and alginate (pH=6.0) solutions was performed in microchannels at a current density of 40 $A/m^2$ and recorded under microscope.

Example 5

Microscopy and Data Analysis

Bright field and fluorescent images were taken with a Ludesco EXI-310 inverted microscope, except that panel (i) of FIG. 18 and panel (i) of FIG. 19 were taken using a iPhone® X and FIG. 29 was taken with a Zeiss® Axio Observer Z1 Inverted Microscope. ImageJ with the Fiji® image processing package (NIH) was used for image processing and the following data analysis. The thickness and area of membranes were measured against a calibration dimension, then the volume of membranes was calculated by multiplying the area of membranes with the thickness of microchannel (50 μm). The tracking of fluorescent particles in the electrofabrication process were analyzed using TrackMate in Fiji to plot the tracked paths and extract the particles tracking data including velocity and spots count. The fluorescent intensity profiles through the membranes were plotted with Fiji®. The average fluorescent intensities of the whole membrane, the chitosan channel with fluorescent beads, and the alginate channel without fluorescent beads as background were quantified at every minute time point. The color of both pH indicators phenol red and xylenol blue inside microchannels (height: 50 μm) and in open space (height: about 1 mm) was calibrated with fixed pH buffer as reference for pH interpretation. Color of images was analyzed and plotted in RGB value for better comparison. The 3D surface plots of phenol red and xylenol blue were generated with Fiji®.

It is intended that the invention not be limited to the particular embodiment disclosed herein contemplated for carrying out this invention, but that the invention will include all embodiments falling within the scope of the claims.

All documents, patents, journal articles and other materials cited in the present application are incorporated herein by reference.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

REFERENCES

The following references are referred to above and are incorporated herein by reference:

1. Chen, X.; Shen, J., Review of membranes in microfluidics. *Journal of Chemical Technology & Biotechnology* 2017, 92 (2), 271-282.
2. Koev, S. T.; Powers, M. A.; Yi, H.; Wu, L.-Q.; Bentley, W. B.; Rubloff, G. W.; Payne, G. F.; Ghodssi, R., Mechanotransduction of DNA hybridization and dopamine oxidation through electrodeposited chitosan network. *Lab on a Chip* 2007, 7 (1), 103-111.
3. Tan, X.; Rodrigue, D., A Review on Porous Polymeric Membrane Preparation. Part I: Production Techniques with Polysulfone and Poly (Vinylidene Fluoride). *Polymers* 2019, 11 (7), 1160.
4. Tasselli, F.; Jansen, J.; Drioli, E., PEEKWC ultrafiltration hollow-fiber membranes: Preparation, morphology, and transport properties. *Journal of Applied Polymer Science* 2004, 91 (2), 841-853.
5. Remanan, S.; Sharma, M.; Bose, S.; Das, N. C., Recent advances in preparation of porous polymeric membranes by unique techniques and mitigation of fouling through surface modification. *ChemistrySelect* 2018, 3 (2), 609-633.
6. Guillen, G. R.; Pan, Y.; Li, M.; Hoek, E. M., Preparation and characterization of membranes formed by nonsolvent induced phase separation: a review. *Industrial & Engineering Chemistry Research* 2011, 50 (7), 3798-3817.

7. Kazek-Kesik, A.; Krok-Borkowicz, M.; Dercz, G.; Donesz-Sikorska, A.; Pamula, E.; Simka, W., Multilayer coatings formed on titanium alloy surfaces by plasma electrolytic oxidation—electrophoretic deposition methods. *Electrochimica Acta* 2016, 204, 294-306.
8. Boccaccini, A.; Keim, S.; Ma, R.; Li, Y.; Zhitomirsky, I., Electrophoretic deposition of biomaterials. *Journal of the Royal Society Interface* 2010, 7 (suppl_5), S581-S613.
9. Schwarzacher, W., Electrodeposition: a technology for the future. Electrochemical Society Interface 2006, 15 (1), 32-33.
10. Li, J.; Wu, S.; Kim, E.; Yan, K.; Liu, H.; Liu, C.; Dong, H.; Qu, X.; Shi, X.; Shen, J., Electrobiofabrication: electrically based fabrication with biologically derived materials. *Biofabrication* 2019, 11 (3), 032002.
11. Jayakrishnan, D. S., Electrodeposition: the versatile technique for nanomaterials. In *Corrosion protection and control using nanomaterials*, Elsevier: 2012; pp 86-125.
12. Schwartz, D. T., Electrodeposition and nanobiosystems. *The Electrochemical Society Interface.* 2006, 15(1), 34.
13. Xu. W.; Fu. K.; Bohn. P. W., Electrochromic sensor for multiplex detection of metabolites enabled by closed bipolar electrode coupling. *ACS Sensors.* 2017, 2 (7), 1020-6.
14. Walker, G.; Ramsey, J.; Cavin III, R.; Herr, D.; Merzbacher, C.; Zhirnov, V., A framework for bioelectronics: Discovery and innovation. *National Institute of Standards and Technology* 2009.
15. Agarwala, S.; Lee, J. M.; Ng, W. L.; Layani, M.; Yeong, W. Y.; Magdassi, S., A novel 3D bioprinted flexible and biocompatible hydrogel bioelectronic platform. *Biosensors and Bioelectronics* 2018, 102, 365-371.
16. Hsiao, Y.-S.; Ho, B.-C.; Yan, H.-X.; Kuo, C.-W.; Chueh, D.-Y.; Yu, H.-h.; Chen, P., Integrated 3D conducting polymer-based bioelectronics for capture and release of circulating tumor cells. *Journal of Materials Chemistry B* 2015, 3 (25), 5103-5110.
17. Katz, E., Implantable bioelectronics—editorial introduction. *Implantable bioelectronics*. Wiley, Weinheim 2014.
18. Prakash, S.; Chakrabarty, T.; Singh, A. K.; Shahi, V. K., Polymer thin films embedded with metal nanoparticles for electrochemical biosensors applications. *Biosensors and Bioelectronics* 2013, 41, 43-53.
19. Simon, D.; Ware, T.; Marcotte, R.; Lund, B. R.; Smith, D. W.; Di Prima, M.; Rennaker, R. L.; Voit, W., A comparison of polymer substrates for photolithographic processing of flexible bioelectronics. *Biomedical Microdevices* 2013, 15 (6), 925-939.
20. Willner, I.; Baron, R.; Willner, B., Integrated nanoparticle—biomolecule systems for biosensing and bioelectronics. *Biosensors and Bioelectronics* 2007, 22 (9-10), 1841-1852.
21. Svennersten, K.; Larsson, K. C.; Berggren, M.; Richter-Dahlfors, A., Organic bioelectronics in nanomedicine. *Biochimica et Biophysica Acta (BBA)-General Subjects* 2011, 1810 (3), 276-285.
22. Berggren, M.; Richter-Dahlfors, A., Organic bioelectronics. *Advanced Materials* 2007, 19 (20), 3201-3213.
23. Yuk, H.; Lu, B.; Zhao, X., Hydrogel bioelectronics. *Chemical Society Reviews* 2019, 48 (6), 1642-1667.
24. Zhang, A.; Lieber, C. M., Nano-bioelectronics. *Chemical Reviews* 2016, 116 (1), 215-257.
25. Bhattarai, N.; Gunn, J.; Zhang, M., Chitosan-based hydrogels for controlled, localized drug delivery. *Advanced Drug Delivery Reviews* 2010, 62 (1), 83-99.
26. Croisier, F.; Jerome, C., Chitosan-based biomaterials for tissue engineering. *European Polymer Journal* 2013, 49 (4), 780-792.
27. Koev, S.; Dykstra, P.; Luo, X.; Rubloff, G.; Bentley, W.; Payne, G.; Ghodssi, R., Chitosan: an integrative biomaterial for lab-on-a-chip devices. *Lab on a Chip* 2010, 10 (22), 3026-3042.
28. Suginta, W.; Khunkaewla, P.; Schulte, A., Electrochemical biosensor applications of polysaccharides chitin and chitosan. *Chemical Reviews* 2013, 113 (7), 5458-5479.
29. Rafique, A.; Zia, K. M.; Zuber, M.; Tabasum, S.; Rehman, S., Chitosan functionalized poly (vinyl alcohol) for prospects biomedical and industrial applications: A review. *International Journal of Biological Macromolecules* 2016, 87, 141-154.
30. Wu, L.-Q.; Gadre, A. P.; Yi, H.; Kastantin, M. J.; Rubloff, G. W.; Bentley, W. E.; Payne, G. F.; Ghodssi, R., Voltage-dependent assembly of the polysaccharide chitosan onto an electrode surface. *Langmuir* 2002, 18 (22), 8620-8625.
31. Wu, S.; Yan, K.; Li, J.; Huynh, R. N.; Raub, C. B.; Shen, J.; Shi, X.; Payne, G. F., Electrical cuing of chitosan's mesoscale organization. *Reactive and Functional Polymers* 2020, 104492.
32. Yi, H.; Wu, L.-Q.; Bentley, W. E.; Ghodssi, R.; Rubloff, G. W.; Culver, J. N.; Payne, G. F., Biofabrication with chitosan. *Biomacromolecules* 2005, 6 (6), 2881-2894.
33. Pang, X.; Zhitomirsky, I., Electrodeposition of composite hydroxyapatite—chitosan films. *Materials Chemistry and Physics* 2005, 94 (2-3), 245-251.
34. Fusco, S.; Chatzipirpiridis, G.; Sivaraman, K. M.; Ergeneman, O.; Nelson, B. J.; Pane, S., Chitosan electrodeposition for microrobotic drug delivery. *Advanced Healthcare Materials* 2013, 2 (7), 1037-1044.
35. Cheng, Y.; Gray, K. M.; David, L.; Royaud, I.; Payne, G. F.; Rubloff, G. W., Characterization of the cathodic electrodeposition of semicrystalline chitosan hydrogel. *Materials Letters* 2012, 87, 97-100.
36. Cheng, Y.; Luo, X.; Betz, J.; Buckhout-White, S.; Bekdash, O.; Payne, G. F.; Bentley, W. E.; Rubloff, G. W., In situ quantitative visualization and characterization of chitosan electrodeposition with paired sidewall electrodes. *Soft Matter* 2010, 6 (14), 3177-3183.
37. Kim, E; Xiong, Y.; Cheng, Y.; Wu, H.-C.; Liu, Y.; Morrow, B. H.; Ben-Yoav, H.; Ghodssi, R.; Rubloff, G. W.; Shen, J., Chitosan to connect biology to electronics: Fabricating the bio-device interface and communicating across this interface. *Polymers* 2015, 7 (1), 1-46.
38. Tsai, C.; Payne G. F.; Shen, J., Exploring pH-responsive, switchable crosslinking mechanisms for programming reconfigurable hydrogels based on aminopolysaccharides. *Chemistry of Materials* 2018 13; 30 (23), 8597-605.
39. Dharmadasa, I.; Haigh, J., Strengths and advantages of electrodeposition as a semiconductor growth technique for applications in macroelectronic devices. *Journal of The Electrochemical Society* 2006, 153 (1), G47-G52.
40. Hu, P.; Raub, C. B.; Choy, J. S.; Luo, X., Modulating the properties of flow-assembled chitosan membranes in microfluidics with glutaraldehyde crosslinking. *Journal of Materials Chemistry B* 2020, 8 (12), 2519-2529.
41. Pham, P.; Vo, T.; Luo, X., Steering air bubbles with an add-on vacuum layer for biopolymer membrane biofabrication in PDMS microfluidics. *Lab on a Chip* 2017, 17 (2), 248-255.
42. Luo, X.; Wu, H.-C.; Betz, J.; Rubloff, G. W.; Bentley, W. E., Air bubble-initiated biofabrication of freestanding, semi-permeable biopolymer membranes in PDMS microfluidics. *Biochemical Engineering Journal* 2014, 89, 2-9.

43. Luo, X.; Wu, H.-C.; Tsao, C.-Y.; Cheng, Y.; Betz, J.; Payne, G. F.; Rubloff, G. W.; Bentley, W. E., Biofabrication of stratified biofilm mimics for observation and control of bacterial signaling. *Biomaterials* 2012, 33 (20), 5136-5143.

44. Luo, X.; Berlin, D. L.; Betz, J.; Payne, G. F.; Bentley, W. E.; Rubloff, G. W., In situ generation of pH gradients in microfluidic devices for biofabrication of freestanding, semi-permeable chitosan membranes. *Lab on a Chip* 2010, 10 (1), 59-65.

45. Gu, Y.; Hegde, V.; Bishop, K. J., Measurement and mitigation of free convection in microfluidic gradient generators. *Lab on a Chip* 2018, 18 (22), 3371-8.

46. Ly, K. L.; Raub, C. B.; Luo, X., Tuning the porosity of biofabricated chitosan membranes in microfluidics with co-assembled nanoparticles as templates. *Materials Advances* 2020, 1 (1), 34-44.

47. Tinevez, J.-Y.; Perry, N.; Schindelin, J.; Hoopes, G. M.; Reynolds, G. D.; Laplantine, E.; Bednarek, S. Y.; Shorte, S. L.; Eliceiri, K. W., TrackMate: An open and extensible platform for single-particle tracking. *Methods* 2017, 115, 80-90.

48. Tamura, Z.; Maeda, M., Differences between phthaleins and sulfonphthaleins. *Yakugaku zasshi: Journal of the Pharmaceutical Society of Japan* 1997, 117 (10-11), 764-770.

49. Li, K.; Correa, S.; Pham, P.; Raub, C.; Luo, X., Birefringence of flow-assembled chitosan membranes in microfluidics. *Biofabrication* 2017, 9 (3), 034101.

The foregoing applications, and all documents cited therein or during their prosecution ("appln cited documents") and all documents cited or referenced in the appln cited documents, and all documents cited or referenced herein ("herein cited documents"), and all documents cited or referenced in herein cited documents, together with any manufacturer's instructions, descriptions, products specifications, and product sheets for any products mentioned herein or in any document incorporated by reference herein, are hereby incorporated herein by reference, and may be employed in the practice of the invention. More specifically, all referenced documents are incorporated by reference to the same extent as if each individual document was specifically and individually indicated to be incorporated by reference.

While the present disclosure has been disclosed with references to certain embodiments, numerous modifications, alterations, and changes to the described embodiments are possible without departing from the sphere and scope of the present disclosure, as defined in the appended claims. Accordingly, it is intended that the present disclosure is not limited to the described embodiments, but that it has the full scope defined by the language of the following claims, and equivalents thereof.

What is claimed is:

1. An interfacial electrofabrication device for producing a freestanding biopolymer membrane comprising:

at least one anode;

at least one cathode;

at least one anode electrolyte; and at least one cathode electrolyte, wherein at least a portion of the at least one anode electrolyte and the at least one cathode electrolyte form an interface, wherein at least one polyelectrolyte complex membrane (PECM) forms at the interface of the at least one anode electrolyte and the at least one cathode electrolyte, wherein the at least one anode electrolyte and the at least one cathode electrolyte are separated by the PECM, wherein the at least one anode is disposed in the at least one anode electrolyte, wherein the at least one cathode is disposed in the at least one cathode electrolyte, and wherein the at least one anode and the at least one cathode are distal from the interface of the at least one anode electrolyte and the at least one cathode electrolyte.

2. The device of claim 1, wherein the at least one anode and the at least one cathode connect to a direct current (DC) power supply.

3. The device of claim 2, wherein the power supply has a constant, intermittent or varying current density.

4. The device of claim 2, wherein the power supply has fixed, intermittent or varying voltage potential.

5. The device of claim 2, wherein current density and voltage potential are in a range to ensure a biopolymer membrane growth with a thickness of at least ten micrometers within 10 minutes.

6. The device of claim 2, wherein the current density is 40-80 $A/m^2$.

7. The device of claim 2, wherein a voltage potential is 3-6 Volts.

8. The device of claim 1, wherein the at least one anode electrolyte contains at least one compound to be fabricated into the freestanding biopolymer membrane.

9. The device of claim 1, wherein the PECM has pores smaller than a molecular size of a compound to be fabricated into the freestanding biopolymer membrane.

10. The device of claim 1, wherein the at least one anode electrolyte is a chitosan solution.

11. The device of claim 10, wherein the chitosan solution has a concentration of 0.5% w/v.

12. The device of claim 10, wherein the chitosan solution has a pH in a range ensuring membrane growth to the thickness of at least ten micrometers within 10 minutes.

13. The device of claim 10, wherein the chitosan solution has a pH in a range of 5-6.

14. The device of claim 1, wherein the at least one cathode electrolyte is a solution containing at least one negatively charged polyelectrolyte.

15. The device of claim 1, wherein the at least one cathode electrolyte is selected from the group consisting of alginate, polystyrene sulfonates (PSS), and polyacrylic acid (PAA) solutions.

16. The device of claim 1, wherein the at least one cathode electrolyte is an alginate solution.

17. The device of claim 16, wherein the alginate solution has a concentration of 0.5% w/v.

18. The device of claim 16, wherein the alginate solution has a pH of 4-11, wherein the alginate solution remains fluidic and wherein the membrane growth is induced by an applied electrical signal but not spontaneous $OH^-$ ion flux.

19. The device of claim 14, wherein the at least one anode electrolyte further comprises at least one compound other than the at least one negatively charged polyelectrolyte, wherein the at least one compound other than the at least one negatively charged polyelectrolyte can be co-deposited.

20. The device of claim 19, wherein the at least one compound other than the at least one negatively charged polyelectrolyte is selected from the group consisting of polymers, proteins and nanoparticles.

21. The device of claim 1, wherein a location of a freestanding biopolymer membrane electrofabrication is an open space.

22. The device of claim 1 further comprising a mesh structure at the interface of the at least one anode electrolyte and the at least one cathode electrolyte.

23. The device of claim 1, wherein the interface of the at least one anode electrolyte and the at least one cathode electrolyte is free of air bubbles.

24. The device of claim 1, wherein the interfacial electrofabrication device has an open configuration that allows fluidic and electrical accesses to vary fluidic compositions and electrical signals during and after a process as needed without interfering with an electrofabrication process.

25. An interfacial electrofabrication device for producing freestanding biopolymer membranes consisting essentially of:

at least one anode;

at least one cathode;

at least one anode electrolyte; and at least one cathode electrolyte, wherein at least a portion of the at least one anode electrolyte and the at least one cathode electrolyte form an interface, wherein at least one polyelectrolyte complex membrane (PECM) forms at the interface of the at least one anode electrolyte and the at least one cathode electrolyte, wherein the at least one anode electrolyte and the at least one cathode electrolyte are separated by the PECM, wherein the at least one anode is disposed in the at least one anode electrolyte, wherein the at least one cathode is disposed in the at least one cathode electrolyte, and wherein the at least one anode and the at least one cathode are distal from the interface of the at least one anode electrolyte and the at least one cathode electrolyte.

* * * * *